US007270925B2

(12) United States Patent
Kamoshida et al.

(10) Patent No.: US 7,270,925 B2
(45) Date of Patent: Sep. 18, 2007

(54) IMAGE CARRIER AND DEVELOPING DEVICE INCORPORATED IN IMAGE FORMING APPARATUS

(75) Inventors: Sinichi Kamoshida, Nagano (JP); Ken Ikuma, Nagano (JP); Yoshiro Koga, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 328 days.

(21) Appl. No.: 10/961,413

(22) Filed: Oct. 8, 2004

(65) Prior Publication Data

US 2005/0112483 A1 May 26, 2005

(30) Foreign Application Priority Data

Oct. 8, 2003 (JP) ..... P2003-349518
Oct. 10, 2003 (JP) ..... P2003-352433

(51) Int. Cl.
*G03G 5/147* (2006.01)

(52) U.S. Cl. ..... 430/58.05; 430/58.1; 430/66

(58) Field of Classification Search ..... 430/58.05, 430/58.1, 66
See application file for complete search history.

(56) References Cited

U.S. PATENT DOCUMENTS 5,464,716 A * 11/1995 Yashiki ..... 430/41
5,729,802 A * 3/1998 Hirabayashi et al. ..... 399/174
5,809,379 A * 9/1998 Yano et al. ..... 399/159
2004/0013442 A1* 1/2004 Suzuki et al. ..... 399/92

FOREIGN PATENT DOCUMENTS

| | | |
|---|---|---|
| JP | 06-003921 | 1/1994 |
| JP | 6-115148 | 4/1994 |
| JP | 06-202465 | 7/1994 |
| JP | 8-050394 | 2/1996 |
| JP | 09-218566 | 8/1997 |
| JP | 3372650 | 11/2002 |
| JP | 2003-084566 | 3/2003 |

* cited by examiner

*Primary Examiner*—John L. Goodrow
(74) *Attorney, Agent, or Firm*—Hogan & Hartson LLP

(57) ABSTRACT

An electrostatic latent image is formed on an image carrier. In the image carrier, a photosensitive layer is provided so as to cover a conductive substrate. Conductive particles are dispersed in the photosensitive layer, such that some of the particles are exposed at a surface of the photosensitive layer.

5 Claims, 13 Drawing Sheets

IMAGE CARRIER AND DEVELOPING DEVICE INCORPORATED IN IMAGE FORMING APPARATUS

BACKGROUND OF THE INVENTION

The present invention relates to an image carrier for use in image forming apparatus such as electrophotography or facsimile, on which a latent image is to be formed, and particularly relates to an image carrier having a photoconductive layer for forming a latent image by optical writing, and having a large number of conductive particles to be charged due to charge injection.

Japanese Patent Publication No. 6-3921A discloses an image forming apparatus in which an image carrier is charged by charge injection so that an electrostatic latent image is formed on the image carrier. In this example, a photoconductive drum serves as the image carrier. The photoconductive drum has a photoconductive layer and a charge injection layer. The photoconductive layer is comprised of a charge generation layer for generating charges in response to received light, and a charge transport layer for transporting the generated charges to the surface of the photoconductive drum. The charge injection layer is formed to have a predetermined film thickness on the charge transport layer in such a manner that conductive filler made of $SnO_2$ in the form of a large number of conductive particles is dispersed into binder resin made from phosphagen resin.

A charger is then brought into contact with the charge injection layer so as to inject charges into $SnO_2$ of the charge injection layer, so that the photoconductive drum is charged uniformly. Next, the photoconductive drum is exposed to a laser beam. The charge generation layer receiving the laser beam generates charges, and positive charges of the generated charges are transported to the surface of the photoconductive drum through the charge transport layer. Thus, the charges are eliminated from the exposed portion of the photoconductive drum surface so that a latent image is formed thereon.

Japanese Patent Publication No. 9-218566A discloses an image carrier having a similar configuration.

When the photoconductive drum is charged in such a charge injection system, charging can be achieved at a low voltage. Accordingly, the power supply cost can be reduced, and generation of ozone products can be prevented. Further, when there is a pin hole or the like in the photoconductive drum, there may occur a failure in image formation due to leakage from the pin hole or the like. Due to charging at a low voltage, however, such a failure can be suppressed to the utmost.

Assume that image formation is performed over a long time period in the above photoconductive drum, the surface layer of the photoconductive drum will be worn by members abutting against the photoconductive drum. Since the above photoconductive drum is arranged to have a charge injection layer only in the surface layer of the photoconductive drum, the charge injection layer will be worn down, thereby charging by the charge injection cannot be performed, and image formation cannot be performed. In other words, the film thickness of the charge injection layer which is the surface layer of the photoconductive drum determines the life of the image forming apparatus. It is therefore difficult to perform charging the photoconductive drum stably over a long time period.

When the surface of the photoconductive drum is filmed by coating of a resin component of toner or the like due to long-term use of the photoconductive drum or the like, charges cannot be injected into the charge injection layer reliably. It is therefore necessary to perform image formation while grinding the surface layer of the image carrier, that is, the charge injection layer positively to thereby remove the filming. However, when the charge injection layer is ground, the film thickness of the charge injection layer determines the life of the image forming apparatus in the same manner as in the aforementioned case where the charge injection layer is worn away. It is therefore difficult to perform charging the photoconductive drum stably over a long time period.

The present invention relates to a developing device for use in the above image forming apparatus to develop a latent image formed on an image carrier, and particularly relates to a FEED type developing device using toner having a minute particle size.

The present invention also relates to image forming apparatus incorporating such an image carrier and such a developing device.

Japanese Patent Publication No. 6-202465A discloses a FEED type developing device comprising a developing roller a surface of which in provided with both of minute conductive regions and minute dielectric regions. A functional layer mainly comprised of carbon is formed on the dielectric regions. In this device, nonmagnetic single-component toner, to which external additive is added if necessary, is supplied onto the developing roller. The toner is held on the developing roller by minute closed electric fields formed in the vicinity of the surface of the developing roller, and carried onto an image carrier on which an electrostatic latent image which has been formed to make the latent image visible as a toner image.

FIGS. 20 to 22 show a case where such a developing device of the FEED type is combined with an image carrier of the charge injection type.

As shown in FIG. 20, an image forming apparatus 21 comprises an image carrier 22 for forming a latent image thereon and for carrying a toner image, a charger 23 having a charging roller 23*a* for charging the image carrier 22 uniformly, an exposer 24 for writing an electrostatic latent image on the image carrier 22 by exposure, a FEED type developing device 25 having a developing roller 25*a* serving as a developing roller, a control blade 25*b* for regulating a thickness of toner on the developing roller 25*a*, and a developing bias power supply 25*c* for supplying a developing bias voltage to the developing roller 25*a*, and a transferer 26 having a transfer roller 26*a*.

The image carrier 22 is comprised of a substrate 22*a* made from a conductive material such as aluminum, an under coated layer 22*b* formed on the substrate 22*a*, a photosensitive layer 22*c* formed on the under coated layer 22*b*, and a charge injection layer 22*d* formed on the photosensitive layer 22*c*. The charge injection layer 22*d* has a configuration in which a large number of conductive particulates (not shown) have been independently dispersed in binder resin 27.

As shown in FIG. 21, the developing roller 25*a* of the FEED type developing device 25 is comprised of a core member 25*d* made from a conductive member, and an insulative portion 25*e* formed on the core member 25*d*. A large number of independent floating electrodes 25*f* are provided in the surface layer of the insulative portion 25*e*. The independent floating electrodes 25*f* are exposed on an outer circumferential surface 25*e*1 of the insulative portion 25*e* while the tip end faces thereof are made flush with the outer circumferential surface 25*e*1. In addition, the developing device 25 has a toner supply roller 25*g* for supplying toner to the developing roller 25*a*.

More specifically, toner T stored in a toner container of the developing device 25 is supplied to the toner supply roller 25*g*. As shown in FIGS. 21 and 22, the toner supply roller 25*g* rotates in the same direction as the developing roller 25*a* so as to charge the developing roller 25*a* and the toner T, so that the toner T is attached onto the developing roller 25*a*. When the developing roller 25*a* rotates further, the control blade 25*b* stabilizes the charged condition of the toner T while regulating the thickness of the toner T on the developing roller 25*a*. Thus, the adhering toner T reaches a development point D where the latent image on the image carrier 22 is to be developed.

In the development point D, the latent image is developed with the toner T in a contact or non-contact manner. Here, if necessary, a developing bias voltage and a supply bias voltage (DC, AC, DC superimposed AC, pulses, etc.) are applied from the developing bias power supply 25*c* and a supply bias power supply 25*h* to the developing roller 25*a* and the toner supply roller 25*g* respectively. Thus, the developed image can be optimized.

Next, description will be made on a mechanism of toner adhesion to the FEED type developing roller 25*a*. The developing roller 25*a* is designed so that a large number of minute independent floating electrodes 25*f* are independently dispersed in the surface layer of the insulative portion 25*e*, as shown in FIG. 22.

The toner T is attached as follows. First, a portion of the developing roller 25*a* which has been subjected to the development comes into contact with the toner supply roller 25*g*. Residual toner T' staying on the developing roller 25*a* is scraped mechanically and electrically by the toner supply roller 25*g*, and received in the toner tank in the developing device, while the independent floating electrodes 25*f* are charged by friction. Due to this frictional charge, charges of the developing roller 25*a* and the residual toner are unified (initialized). Next, the toner T conveyed from the toner tank by the toner supply roller 25*g* is charged by friction so as to electrostatically adhere to the independent floating electrodes 25*f* of the developing roller 25*a*.

As for polarities at this time, the toner T has an inversed polarity to the charges on the image carrier, while the independent floating electrodes 25*f* of the developing roller 25*a* have the same polarity as the charges on the image carrier. Incidentally, as shown in FIG. 22, minute closed electric fields E each having a large gradient are formed, thereby the toner T can be attached thereto in multiple layers. Further, due to the closed electric fields E, the toner T adhering to the independent floating electrodes 25*f* is hardly separated from the developing roller 25*a*. The toner T is carried to the development point D while its thickness is regulated by the control blade 25*b*. At the development point D, the electric field condition is made such that the toner T on the developing roller 25*a* is readily adhered onto the image carrier 22.

Then, the charging roller 23*a* of the charger 23 is brought into contact with the charge injection layer 22*d* so as to inject charges into the conductive particulates of the charge injection layer 22*d* of the image carrier 22 due to the charging voltage of the charging roller 23*a*. Thus, the image carrier 22 is charged uniformly. When the charged image carrier 22 is exposed to light by the exposer 24, a latent image is written on the image carrier 22. In the developing device 25, the toner supply roller 25*g* to which the supply bias voltage is applied conveys the toner T onto the developing roller 25*a*. The developing roller 25*a* to which the developing bias voltage is applied carries the toner T onto the image carrier 22.

The latent image written on the image carrier 22 is developed with the toner T conveyed by the developing roller 25*a*. The toner image TI obtained thus is transferred to a not-shown recording medium such as paper by the transfer roller 26*a* of the transferer 26. The toner image transferred to the recording medium is fixed by a not-shown fuser. Thus, an image is formed on the recording medium.

Assume that such a single-component minute toner is used in a non-FEED type developing device. A developing roller of such a developing device has mechanical surface roughness. Therefore, the developing roller is filmed with the minute toner when the minute toner is conveyed by the developing roller and regulated by the control blade. This is because smaller toner particles of the minute toner intrude into the minute irregularities of the developing roller surface so that the irregularities are filmed with the smaller toner particles.

Therefore, when the FEED type developing device shown in FIGS. 20 and 21 is used, the toner T electrostatically adheres to the independent floating electrodes 25*f*, and the toner T adhering to the independent floating electrodes 25*f* is hardly separated therefrom. Thus, filming of the developing roller 25*a* with the toner T is suppressed.

However, in the above described FEED type developing device, the independent floating electrodes 25*f* are flush with the outer circumferential surface 25*e*1 of the insulative portion 25*e*. Therefore, as shown in FIG. 22, the toner T also adheres to the insulative portion 25*e* in the vicinity of the independent floating electrodes 25*f*. When printing is performed over a long time period, the circumferential edge portions of the independent floating electrodes 25*f* and the insulative portion 25*e* in the vicinity of the independent floating electrodes 25*f* are filmed with the toner adhering to the insulative portion 25*e*. As a result, the area where the toner T to be used for development can occupy the independent floating electrodes 25*f* is made small, so that not only the toner carrying capacity is changed but also a required toner carrying ability cannot be secured. Thus, there occurs a failure in image formation.

SUMMARY OF THE INVENTION

It is therefore an object of the invention to provide an image carrier in image forming apparatus in which changing by charge injection is performed stably over a long time period so that image formation can be reliably performed over a long time period.

It is also an object of the invention to provide a FEED type developing device which can prevent a failure in image formation due to filming in spite of the use of minute toner, so that superior image formation can be reliably performed over a long time period.

It is also an object of the invention to provide an image forming apparatus incorporating at least one of such an image carrier and a developing device.

In order to achieve the above objects, according to the invention, there is provided an image carrier in an image forming apparatus, on which an electrostatic latent image is formed, the image carrier comprising:

a conductive substrate;

a photosensitive layer, provided so as to cover the substrate; and conductive particles, dispersed in the photosensitive layer such that some of the particles are exposed at a surface of the photosensitive layer.

Preferably, a concentration of the particles closer to the surface of the photosensitive layer is higher than a concentration of the particle closer to the substrate.

Here, it is preferable the photosensitive layer has a layer in which none of the particles is contained.

Alternatively, it is preferable that the concentration of the particles gradually decreases from a region closer to the surface of the photosensitive layer to a region closer to the substrate.

Preferably, the photosensitive layer comprises: a charge generation layer, which generates charges in response to incident light; and a charge transport layer, laminated on the charge generation layer to transport the generated charge to the surface of the photosensitive layer. Here, the particles are dispersed in the charge transport layer.

Alternatively, it is preferable that the photosensitive layer is a single layer having both of a function for generating charges in response to incident light and a function for transporting the generated charges to the surface of the photosensitive layer.

Preferably, a charge injection layer, in which conductive particles are dispersed, is laminated on the surface of the photosensitive layer.

Here, it is preferable that some of the particles are exposed at a surface of the charge injection layer.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Embodiments of the invention will be described below in detail with reference to the accompanying drawings.

Figure 1:
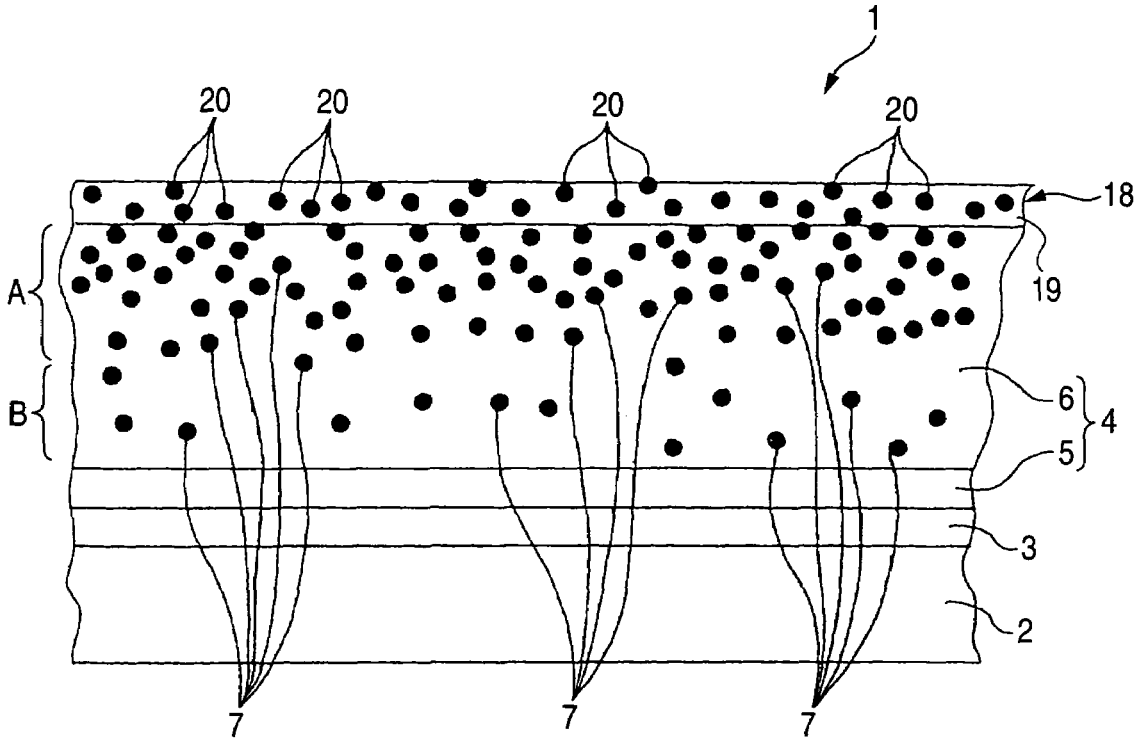
FIG. 1 is a schematic section view of an image carrier according to a first embodiment of the invention.

As shown in FIG. 1, an image carrier 1 according to a first embodiment is comprised of a substrate 2, an under coated layer 3 formed on the substrate 2, a photoconductive layer 4 formed on the under coated layer 3, and a charge injection layer 18 formed on the photoconductive layer 4. The photoconductive layer 4 is formed out of a laminate of a charge generation layer 5 formed on the under coated layer 3, and a charge transport layer 6 formed on the charge generating layer 5. Each of the charge transport layer 6 and the charge injection layer 18 contains a large number of independent conductive particles 7, 20 dispersed in both of the lateral direction and the vertical direction (the circumferential direction and the radial direction of a photoconductive drum described later).

Thus, the image carrier 1 is constructed as a multi-layer type in which a charge generation function and a charge transport function are realized by individual layers (i.e., the charge generating layer 5 and the charge transport layer 6). In addition, due to the lamination of the charge transport layer 6 having a large number of dispersed independent conductive particles 7 and the charge injection layer 18 having a large number of dispersed independent conductive particles 20, the image carrier 1 has a two-stage configuration as its conductive portion to be charge-injected.

The substrate 2 is formed into a cylinder out of a conductive material such as aluminum. In that case, the substrate 2 is formed to have an outer diameter of about 30 mm and a thickness of 1-2 mm.

The under coated layer 3 is an electrically insulating thin film layer provided for blocking charge injection from the surface of the photoconductive layer 4 or the substrate 2. For example, the under coated layer 3 is formed out of a resin layer of nylon resin or the like, or an anodized aluminum layer. The film thickness of the under coated layer 3 is 0.5-5 μm, preferably 0.5-1.5 μm.

The charge generating layer 5 is a layer having a function of generating charges in response to received light. The charge generating layer 5 may be of a type in which the charge generating layer 5 is formed by dispersing a charge generation material into binder resin, or of a type in which the charge generating layer 5 is formed by vacuum deposition of an amorphous silicon layer on the aforementioned substrate 2. The film thickness of the charge generating layer 5 is 0.5-2 μm, preferably 0.5-1.5 μm.

In the type in which a charge generation material has been dispersed in binder resin, for example, resin such as polyvinyl butyral resin can be used as the binder resin. Bisazo-based or phthalocyanine-based pigment can be used as the charge generation material. The charge generating layer 5 is formed by applying the charge generation material onto the under coated layer 3 so as to have a predetermined film thickness within the aforementioned film thickness range. Then, by use of the bisazo-based or phthalocyanine-based pigment, the image carrier 1 is constructed as an organic photoconductor (OPC).

On the other hand, in the type in which an amorphous silicon layer is vacuum-deposited on the substrate 2, the conductive particles 7 are vacuum-deposited together when amorphous silicon is vacuum-deposited. Thus, the charge generating layer 5 is formed. The image carrier 1 is constructed as an inorganic photoconductor.

The charge transport layer 6 is a layer having a function of transporting charges generated in the charge generating layer 5. The charge transport layer 6 is formed by mixing a compound having a charge transport property (hereinafter also referred to as "charge transport material") into well-known binder resin exhibiting a dielectric property. For example, resin having an insulating property and exhibiting a dielectric property, such as polycarbonate, polyethylene, polyvinyl chloride, polyolefin or polyethylene terephthalate, can be used as the binder resin. For example, a hydrazone-based charge transport material can be used as the charge transport material. The charge transport layer 6 is formed by application onto the charge generating layer 5 so as to have a predetermined film thickness (10-30 μm).

Further, metal particles of tungsten, molybdenum, tantalum, gold, silver, iron, etc., particles of tin oxide ($SnO_2$) doped with antimony, indium or the like to be thereby made conductive, or particles of other metal oxides such as titanium oxide ($TiO_2$), conductive carbon or the like, can be used as the conductive particles 7 independently dispersed in the charge transport layer 6. In that case, since both the latent image formation based on optical writing and the latent image formation based on charge writing without using light are performed on the image carrier 1 according to the invention, it is preferable to use particles of optically transparent $SnO_2$ treated to be conductive as described above, or finer particles having a sub-micrometer (not larger than 1 μm) particle size small enough not to prevent the light transmittance in the case of optical writing.

In this embodiment, the concentration of the conductive particles 7 is set to be relatively high in an upper (i.e., the surface side) portion A of the charge transport layer 6 and to be relatively low in a lower (i.e., the substrate side) portion B of the charge transport layer 6. The concentration of the conductive particles 7 is defined by the area covered with the conductive particles 7 per unit area in the charge transport layer 6 at a certain radius of the image carrier 1.

The concentration of the conductive particles 7 at a certain radial face can be evaluated in the following manner by way of example. That is, the surface layer of the charge transport layer 6 is shaved to reveal a certain radial face to the outside. The revealed face is observed by an optical microscope, and the area of the revealed face covered with the conductive particles 7 is measured. Thus, the concentration of the conductive particles 7 in that face is evaluated. Alternatively, the area of a revealed face coated with the conductive particles 7 in a set area of the revealed face may be measured. When the area of the revealed face coated with the conductive particles 7 is divided by the set area of the revealed face, the concentration of the conductive particles 7 can be evaluated.

When the charge transport layer 6 containing the conductive particles 7 is applied onto the charge generating layer 5, the application is performed in the state where the charge transport material and the binder resin containing the conductive particles 7 have been dissolved in a solvent. In that case, tetrahydrofran or acetone can be used as the solvent. The solvent is not limited to those, but any solvent may be used if the binder resin can be dissolved in the solvent.

The charge injection layer 18 is constructed so that a large number of conductive particles 20 are substantially uniformly dispersed in binder resin 19. The film thickness of the charge injection layer 18 is 1-15 μm, preferably 2-5 μm, for the following reason. That is, when the charge injection layer 18 is too thin, the charge injection layer 18 will be shaved off so that the durability will be lost. On the contrary, when the charge injection layer 18 is too thick, the light energy in optical writing will be absorbed (i.e., converted into heat) or latent image data written optically will leak in the surface direction in the charge injection layer 18 so that the latent image may be blurred.

Examples of resins usable as the binder resin 19 include phosphazene resin, polycarbonate resin, polyacethylene resin, polyimide resin, polyvinyl acetate resin, etc. However, the binder resin 19 is not limited to those resins. Any resin may be used if it has an insulating property and exhibits a dielectric property. The same material as the aforementioned material of the conductive particles 7 independently dispersed in the charge transport layer 6 can be used for the conductive particles 20. In that case, it is preferable to use $SnO_2$ particles high in light transmittance to make light reach the charge generating layer 5 reliably and efficiently at the time of optical writing based on exposure. On the other hand, when particles other than $SnO_2$ particles high in light transmittance are used, it is preferable to use finer particles having a sub-micrometer (not larger than 1 μm) particle size small enough not to prevent the light transmittance at the time of optical writing.

Next, description will be made on an example of a method for manufacturing the above image carrier 1.

The method for manufacturing the image carrier 1 arranged as an OPC is fundamentally the same as that for the well-known photoconductive drum. The image carrier 1 can be manufactured in a dip coating method (water method). First, for example, a under coated layer solution in which methoxymethylated nylon exhibiting ionic conductivity to some extent has been mixed into insulating nylon resin is applied onto a cylindrical substrate 2 made from an aluminum material and having an outer diameter of about 30 mm and a thickness of 1.5 μm so that an electrically insulating thin film under coated layer 3 is formed to be about 1 μm thick.

Next, a solution in which polyvinyl butyral resin serving as the binder resin and bisazo-based pigment serving as the charge generation material have been dispersed at a weight ratio of 1:2 is applied onto the formed under coated layer 3 so as to form the charge generating layer 5 about 1 μm thick. Next, charge transport layer resin in which polycarbonate resin serving as the binder resin and hydrazone serving as the charge transport material have been dispersed at a weight ratio of 1:1, and molybdenum particles serving as the conductive particles 7 are dissolved in a tetrahydrofran solvent so as to obtain a solution for the charge transport layer 6 (hereinafter, referred as a CTL coating solution) having the conductive particles 7 dispersed independently. The CTL coating solution is applied onto the formed charge generating layer 5.

In that case, when the CTL coating solution is applied simply in the same manner as for the well-known photoconductive drum, the concentration of the conductive particles 7 on the surface layer side of the charge transport layer 6 cannot be set to be higher than the concentration of the conductive particles 7 on the substrate side of the charge transport layer 6. Therefore, in this embodiment, application is performed in first and second application steps, and first and second coating solutions as will be shown below are used as CTL coating solutions in the first and second application steps respectively so as to vary the concentration of the conductive particles 7 in the photoconductive layer 4.

Specifically, the first coating solution to be used in the first application step is produced as follows. Molybdenum particles whose mean number particle size is 3 μm is set to account for A % (e.g. 15%) by weight, and the aforementioned charge transport layer resin is set to account for (100-A) % (e.g. 85%) by weight. A solution is prepared using tetrahydrofran as a solvent so that the concentration of solid concentrations (the conductive particles 7 and the charge transport layer resin) is 20% by weight. Then, the solution in which the molybdenum particles having a mean number particle size of 3 μm, the charge transport layer resin and the tetrahydrofran have been mixed thus is put into a vessel having a volume of 500 ml, together with glass beads, and dispersed by a paint shaker. Thus, the first coating solution is completed.

The second coating solution to be used in the second application step is produced as follows. Molybdenum particles whose mean number particle size is 3 μm is set to account for B % (B>A, e.g. 25%) by weight larger than the aforementioned ratio A % by weight, and the aforementioned charge transport layer resin is set to account for (100-B) % (e.g. 75%) by weight. A solution is prepared using tetrahydrofran as a solvent so that the concentration of solid concentrations is 20% by weight. Then, in the same manner as in the case of the first coating solution, the solution in which the molybdenum particles having a mean number particle size of 3 μm, the charge transport layer resin and the tetrahydrofran have been mixed thus is put into a vessel having a volume of 500 ml, together with glass beads, and dispersed by a paint shaker. Thus, the second coating solution is completed.

The first coating solution is applied onto the charge generating layer 5 and dried in the first application step. Thus, a first coating is formed on the charge generating layer 5. Next, the second coating solution is applied onto the first coating and dried in the second application step. Thus, a second coating is formed on the first coating. In this event, since the first and second coating solutions are different in solid concentration (mixture ratio), the coating solutions are slightly different in viscosity. However, the coating speeds in the first and second application steps may be set to be substantially equal to each other.

In such a manner, application is performed while changing the concentration of the conductive particles 7 in each coating solution to be lower in the first application step and higher in the second application step. Thus, it is possible to form the charge transport layer 6 in which the concentration of the conductive particles 7 on the surface layer side is higher than the concentration of the conductive particles 7 on the substrate side.

Next, as the conductive particles 20, particles of tin oxide ($SnO_2$) doped with antimony, indium or the like to be thereby made conductive are independently dispersed into phosphazene resin serving as the binder resin, so as to account for 70% by weight. The solution obtained thus is applied onto the formed charge transport layer 6 so as to form the charge injection layer 18 about 5 μm thick. Thus, the image carrier 1 according to the first embodiment is manufactured.

In this embodiment, a large number of conductive particles 7 are independently dispersed in the charge transport layer 6 of the photoconductive layer 4 so that the image carrier 1 can be charged by charge injection. In addition, the charge injection layer 18 in which a large number of conductive particles 20 are independently dispersed is formed on the charge transport layer 6 in which the conductive particles 7 are independently dispersed. Thus, the charge injection can be performed more effectively so that charging by the charge injection can be achieved more reliably.

Figure 2:
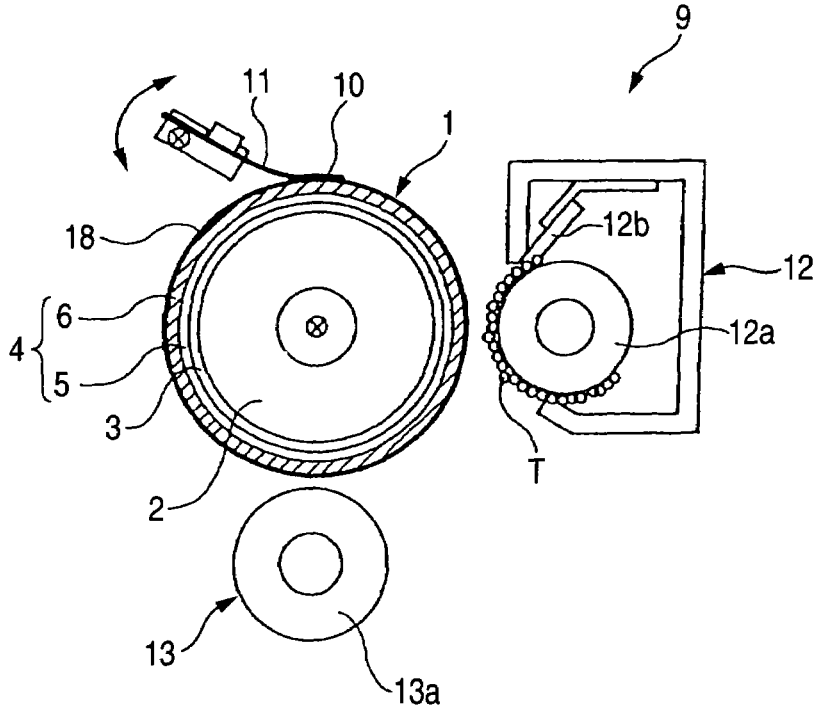
FIG. 2 is a schematic view of an image forming apparatus incorporating the image carrier of the invention, wherein an electrostatic latent image is formed by charge injection.

Accordingly, the image carrier 1 can be applied to both the latent image formation based on charge writing and the latent image formation based on optical writing. That is, the image carrier 1 can be applied to image forming apparatus 9 for forming a latent image based on charge writing as shown in FIG. 2. The image forming apparatus 9 has at least a head 10 for writing an electrostatic latent image on the image carrier 1, a flexible substrate 11 for supporting the writing head 10, a developer 12 having a developing roller 12*a* as a toner carrier and a control blade 12*b* for regulating the layer thickness of developing agent (toner T) on the developing roller 12*a*, and a transferer 13 having a transfer roller 13*a*.

The writing head 10 is brought into contact with the charge injection layer 18 so as to inject charges into the conductive particles 20 in the surface of the charge injection layer 18 in accordance with a writing voltage of the writing head 10. Thus, a latent image is written on the image carrier 1. The latent image written on the image carrier 1 is developed with developing agent (toner T) of the developer 12. A toner image obtained thus is transferred by the transferer 13 onto a not-shown recording medium such as paper. The toner image transferred on the recording medium is fixed by a not-shown fuser. Thus, an image is formed on the recording medium.

Figure 3:
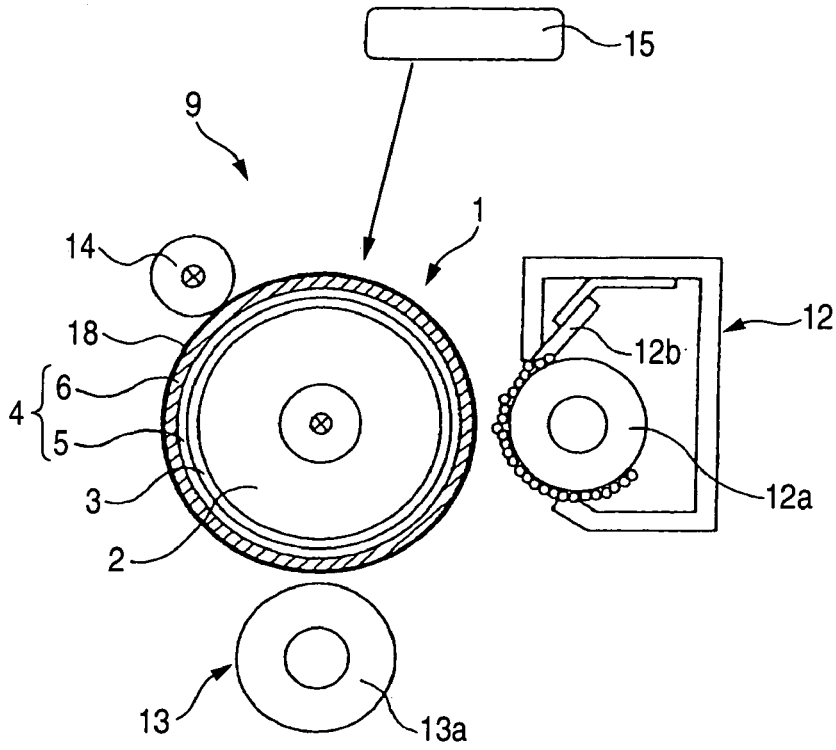
FIG. 3 is a schematic view of an image forming apparatus incorporating the image carrier of the invention, wherein an electrostatic latent image is formed by light writing.

The image carrier 1 can be also applied to image forming apparatus 9 for forming a latent image by optical writing as shown in FIG. 3. The image forming apparatus 9 comprises a charger 14 for charging the image carrier 1 uniformly, an exposer 15 for writing an electrostatic latent image on the image carrier 1 by exposure. The developer 12 and the transferer 13 are similar to those shown in FIG. 2.

For example, the charging roller of the charger 14 is brought into contact with the charge injection layer 18 so as to inject charges into the conductive particles 20 of the charge injection layer 18 of the image carrier 1 due to a charging voltage of the charging roller. Thus, the image carrier 1 is charged uniformly. When the charged image carrier 1 is exposed to light by the exposer 15, the charge generating layer 5 receiving the light generates charges. The generated charges are transported to the surface of the image carrier 1 through the charge transport layer 6 and the conductive particles 20 of the charge injection layer 18. Thus, a latent image is written on the image carrier 1. Then, development, transfer and fixation are performed in the same manner as in the case of the image forming apparatus 9 shown in FIG. 2. Thus, an image is formed on a recording medium.

In the aforementioned charge writing and optical writing, the conductive particles 7 in the surface of the charge transport layer 6 will appear even if the charge injection layer 18 is worn away due to long-term use of the image carrier 1 or the like. Accordingly, when the writing head 10 is brought into contact with the conductive particles 7 so as to inject charges therein, a latent image is written on the image carrier 1. When the latent image written on the image carrier 1 is developed, transferred and fixed in the same manner as described above, an image is formed on a recording medium such as paper.

Although the under coated layer 3 is provided on the substrate 2, the under coated layer 3 may be omitted. Since the photoconductive layer 4 may be formed directly on the substrate 2, it should be expressed that the photoconductive layer 4 is provided above the substrate 2.

Further, a charge prohibition layer may be provided between the substrate 2 and the under coated layer 3. With this configuration, charge injection between the substrate 2 and each upper coating layer (under coated layer 3, charge generating layer 5, charge transport layer 6) on the substrate 2 can be prevented reliably.

According to this embodiment, since the charge injection layer 18 having a large number of conductive particles 20 dispersed independently is provided on the charge transport layer 6 having a large number of conductive particles 7 dispersed independently, the image carrier 1 can be charged reliably by charge injection.

In addition, even when the number of prints increases to wear away the charge injection layer 18, the conductive particles 7 in the surface of the charge transport layer 6 are revealed so that the image carrier 1 can be charged stably over a long time period. Accordingly, latent image formation based on optical writing and latent image formation based on charge writing can be performed over a long time period. Thus, both the image formation based on the optical writing and the latent image formation based on the charge writing can be performed over a long time period and reliably. In that case, even when the surface of the charge injection layer 18 is filmed with a resin component of toner or the like due to long-term use of the image carrier 1 or the like, the surface layer of the charge injection layer 18 may be positively ground to remove the filming. Thus, new conductive particles 20 can be revealed.

Further, even when the surface of the charge transport layer 6 is filmed likewise after the charge injection layer 18 has been shaved out, the surface layer of the charge transport layer 6 may be ground positively to remove the filming. Thus, new conductive particles 7 can be revealed. Accordingly, even when the surface of the image carrier 1 is filmed, the image carrier 1 can be charged stably over a long time period so that image formation can be performed reliably over a longer time period.

In a case where a large number of conductive particles 7 are dispersed in the thickness direction of the charge transport layer 6, charges may leak in the thickness direction of the image carrier 1 due to a high voltage applied for charging, development, transfer or the like. According to this embodiment, however, since the concentration of the conductive particles 7 is set to be lower on the substrate side of the charge transport layer 6, leakage of charges (dielectric breakdown) in the thickness direction of the image carrier 1 can be prevented.

Further, not only the conductive particles 7 dispersed in the charge transport layer 6 but also the conductive particles 20 dispersed in the charge injection layer 18 exhibit the charge transport function. Accordingly, the charge transport speed (i.e., transport speed of charges generated by light received at the charge generating layer 5 at the time of latent image formation by optical writing) is enhanced.

Figure 4:
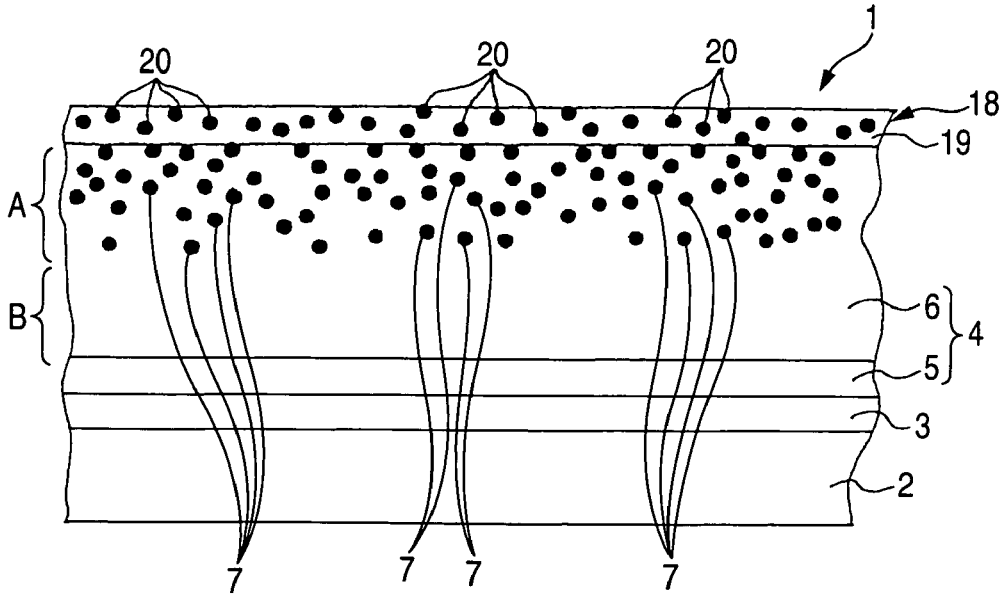
FIG. 4 is a schematic section view of an image carrier according to a second embodiment of the invention.

FIG. 4 shows a second embodiment of the invention. In the following description of each embodiment, constituent members the same as those in the other embodiments described previously are designated by the same reference numerals, and repetitive explanations for those will be omitted.

In this embodiment, no conductive particles 7 are contained in a lower (i.e., the substrate side) portion B of the charge transport layer 6. On the other hand, an upper (i.e., the surface layer side) portion A of the charge transport layer 6 contains a large number of conductive particles 7 dispersed independently in the same manner as the first embodiment.

Even in such a case, the expression that the concentration of the conductive particles 7 is higher on the surface layer side of the charge transport layer 6 than the substrate side thereof.

In this embodiment, coating solutions are applied in first and second application steps in the same manner as in the method for manufacturing the image carrier 1 of the first embodiment. A CTL coating solution containing no conductive particles 7 is used in the first application step of the application solution. A CTL coating solution containing conductive particles 7 is used in the second application step for the CTL coating solution in quite the same manner as the CTL coating solution used in the second application step in the method for manufacturing the image carrier 1 according to the first embodiment. The other steps are the same as those in the manufacturing method of the first embodiment.

Figure 5:
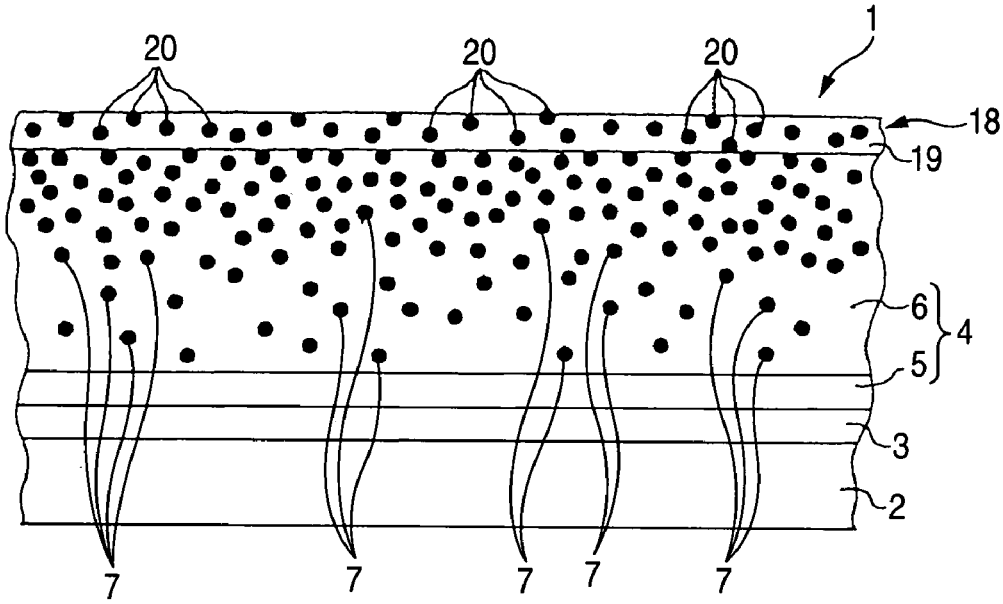
FIG. 5 is a schematic section view of an image carrier according to a third embodiment of the invention.

FIG. 5 shows a third embodiment of the invention. In this embodiment, the concentration of the conductive particles 7 is reduced gradually from the surface layer side of the charge transport layer 6 toward the substrate side of the charge transport layer 6.

To manufacture the image carrier 1 of this embodiment, the CTL coating solutions are applied in three or more plural application steps. In that case, the CTL coating solution used in the first application step contains no conductive particles 7, or the concentration of the conductive particles 7 is set to be the lowest if they are contained. The concentration of the conductive particles 7 of the CTL coating solution used in the second application step is set to be slightly higher than that of the CTL coating solution in the first application. Further, the concentration of the conductive particles 7 of the CTL coating solution used in the third application step is set to be slightly higher than that of the CTL coating solution in the second application step. In such a manner, the concentration of the conductive particles 7 of each CTL coating solution is set to increase gradually as the application step using the CTL coating solution is later.

Other steps are the same as those of the manufacturing method for the image carrier 1 of the first embodiment.

Figure 6:
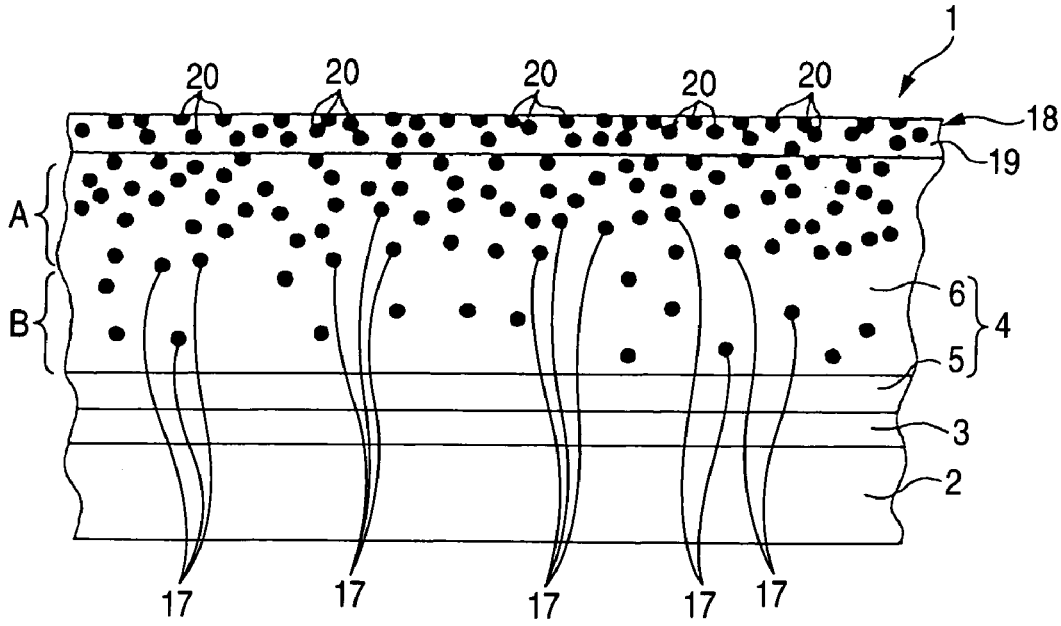
FIG. 6 is a schematic section view of an image carrier according to a fourth embodiment of the invention.

FIG. 6 shows a fourth embodiment of the invention. In this embodiment, a large number of conductive particles 20 are independently dispersed into the charge injection layer 18 while some of the conductive particles 20 are exposed on the surface of the charge injection layer 18.

In order to expose some of the conductive particles 20, a tetrahydrofran or acetone solvent is applied, by a dipping method or a spraying method, onto the charge injection layer 18 having a large number of conductive particles 20 dispersed independently, so as to dissolve the binder resin 19 of the charge injection layer 18. Incidentally, the solvent is not limited to tetrahydrofran or acetone, but any solvent may be used if it can dissolve the binder resin 19.

Alternatively, in the image carrier 1, the surface layer of the charge injection layer 18 may be ground by mechanical means such as filing or sand-blasting so as to expose the part of the conductive particles 20.

With this configuration, since the part of the conductive particles 20 are exposed on the surface of the charge injection layer 18, the image carrier 1 can be charged uniformly and reliably by the charge injection.

The other steps are the same as those of the manufacturing method for the image carrier 1 of the first embodiment.

Figure 7:
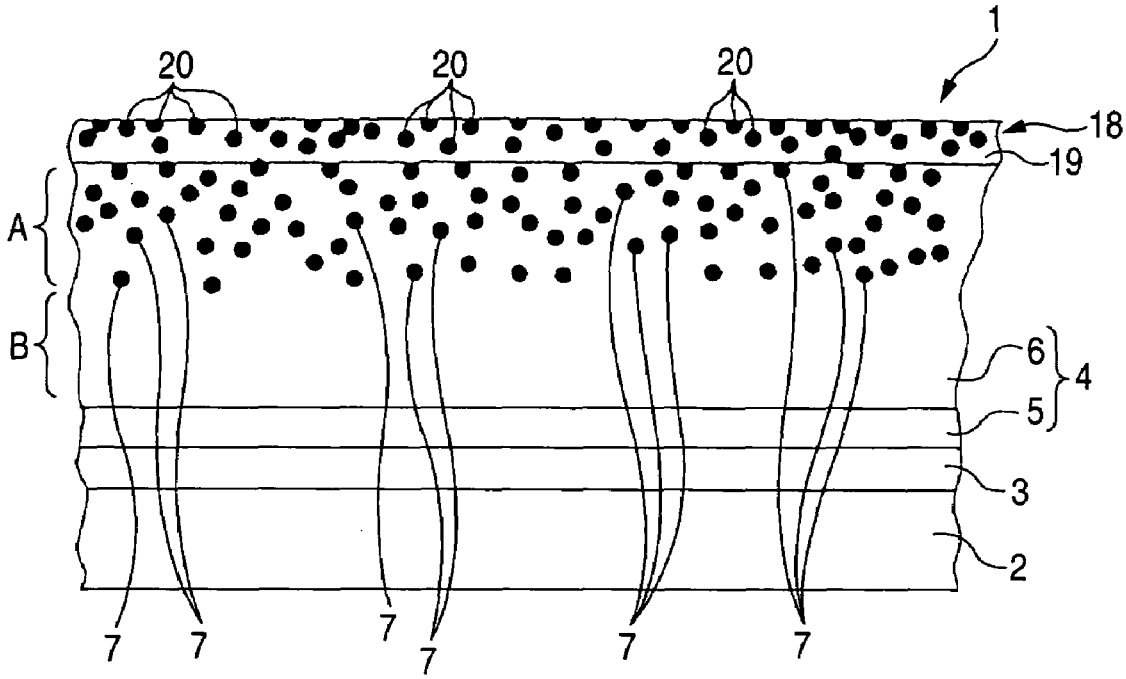
FIG. 7 is a schematic section view of an image carrier according to a fifth embodiment of the invention.

FIG. 7 shows a fifth embodiment of the invention. In this embodiment, no conductive particles 7 are contained in the lower portion B of the charge transport layer 6 in the same manner as in the second embodiment. Any others are the same as those in the fourth embodiment.

Figure 8:
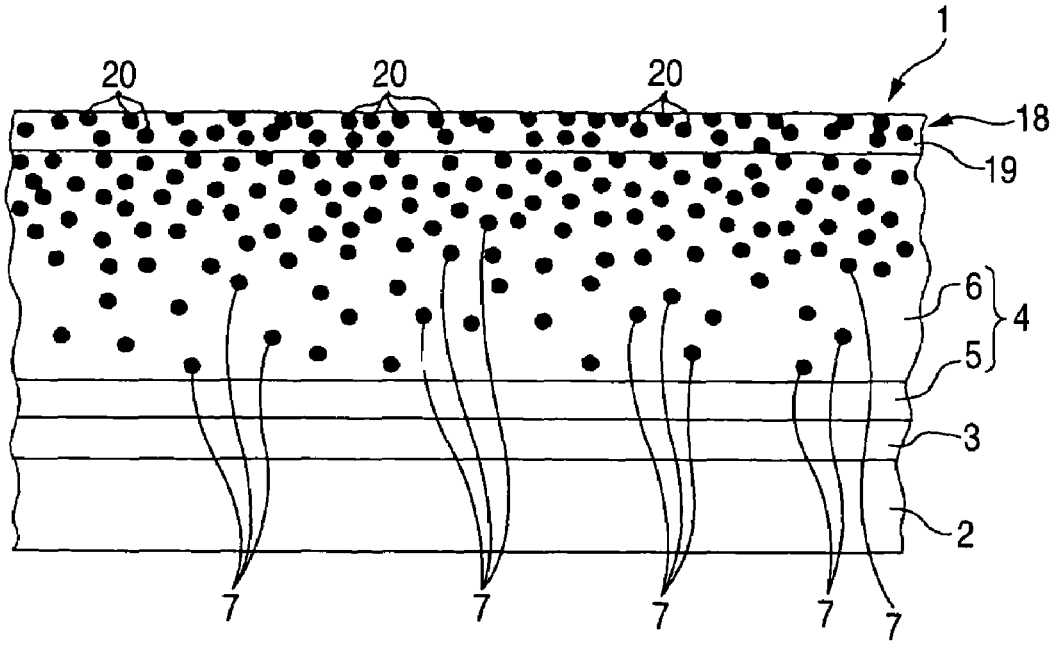
FIG. 8 is a schematic section view of an image carrier according to a sixth embodiment of the invention.

FIG. 8 shows a sixth embodiment of the invention. In this embodiment, the concentration of the conductive particles 7 is reduced gradually from the surface layer side of the charge transport layer 6 toward the substrate side of the charge transport layer 6 as in the third embodiment. Any others are the same as those in the fourth embodiment.

Figure 9:
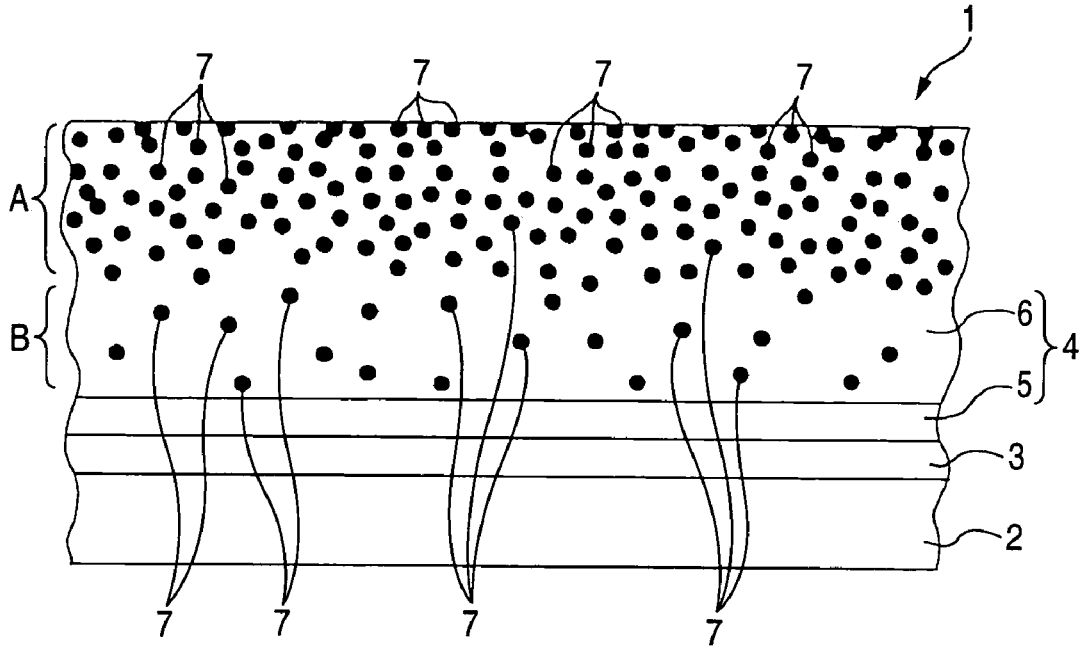
FIG. 9 is a schematic section view of an image carrier according to a seventh embodiment of the invention.

FIG. 9 shows a seventh embodiment of the invention. In this embodiment, the charge injection layer 18 is not provided on the charge transport layer 6, but the charge transport layer 6 contains a large number of conductive particles 7 dispersed independently while some of the conductive particles 7 are exposed on the surface of the charge transport layer 6.

To expose the part of the conductive particles 7, a tetrahydrofran or acetone solvent is applied, by a dipping method or a spraying method, onto the charge transport layer 6 having a large number of conductive particles 7 dispersed independently, so as to dissolve the binder resin of the charge transport layer 6, in the same manner as the fourth embodiment. Incidentally, the solvent is not limited to tetrahydrofran or acetone, but any solvent may be used if it can dissolve the binder resin of the charge transport layer 6.

Alternatively, the surface layer of the charge transport layer 6 may be ground by mechanical means such as filing or sand-blasting so as to expose the part of the conductive particles 7.

With this configuration, since the conductive particles 7 are exposed on the surface of the charge transport layer 6, the image carrier 1 can be charged uniformly and reliably by the charge injection. Any others are the same as those in the first embodiment.

Figure 10:
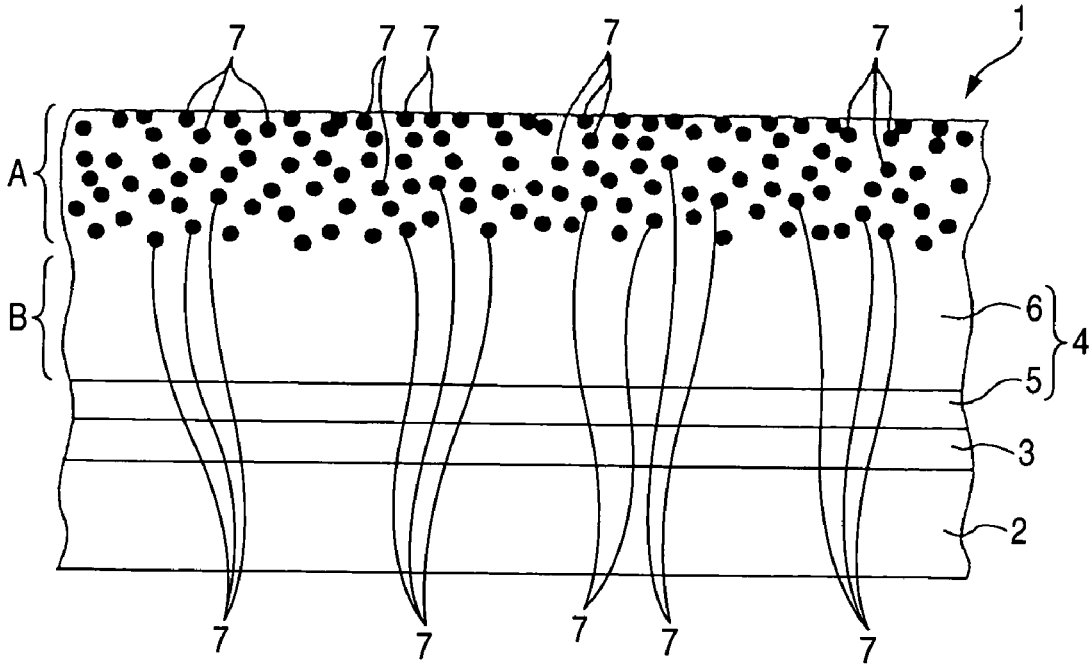
FIG. 10 is a schematic section view of an image carrier according to an eighth embodiment of the invention.

FIG. 10 shows an eighth embodiment of the invention. In this embodiment, no conductive particles 7 are contained in the lower portion B of the charge transport layer 6 as in the second embodiment. Any others are the same as those in the seventh embodiment.

Figure 11:
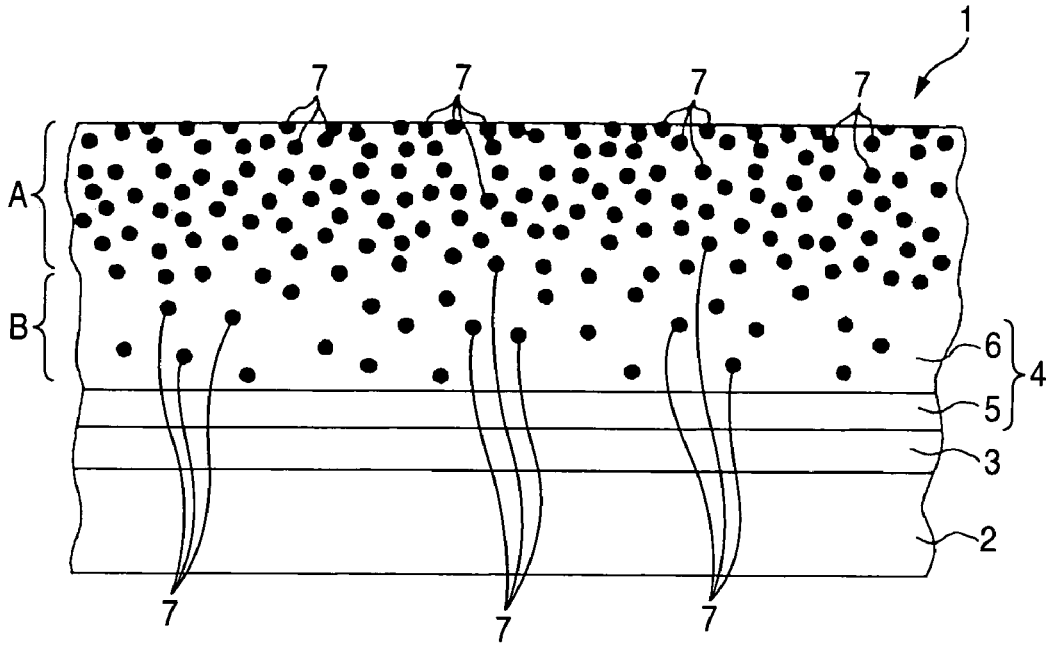
FIG. 11 is a schematic section view of an image carrier according to a ninth embodiment of the invention.

FIG. 11 shows a ninth embodiment of the invention. In this embodiment, the concentration of the conductive particles 7 is reduced gradually from the surface layer side of the charge transport layer 6 toward the substrate side of the charge transport layer 6, as in the third embodiment. Any others are the same as those in the seventh embodiment.

Figure 12:
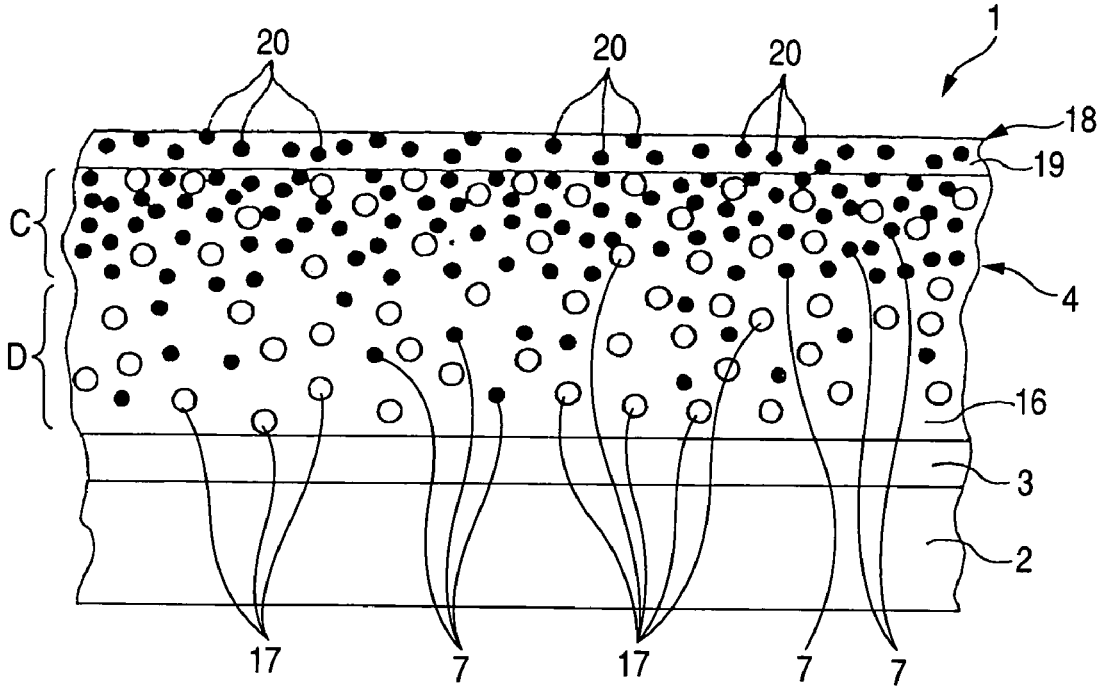
FIG. 12 is a schematic section view of an image carrier according to a tenth embodiment of the invention.

FIG. 12 shows a tenth embodiment of the invention. In this embodiment, the image carrier 1 is constructed as a single-layer type in which the photoconductive layer 4 is not separated into a charge generation layer and a charge transport layer but both the functions are provided by the single-layer photoconductive layer 4.

Specifically, the photoconductive layer 4 has a large number of photoconductive particles 17 substantially uniformly dispersed in binder resin 16. Examples of resins useable as the binder resin 16 include polycarbonate resin, polyacethylene resin, polyimide resin, polyvinyl acetate resin, etc. The binder resin 16 is not limited to these resins. Any resin can be used if it is a resin having an insulating property and exhibiting a dielectric property. The photoconductive particles 17 have both a charge generation function and a charge transport function. Zinc-oxide particles, phthalocyanine pigments, etc. can be used as the photoconductive particles 17.

Further, the resin 16 contains a large number of conductive particles 7 independently dispersed in the lateral direction (extending direction) and the vertical direction (thickness direction) of the photoconductive layer 4. Incidentally, the concentration of the photoconductive particles 7 is set to be relatively high in an upper (i.e., the surface layer side) portion C of the photoconductive layer 4 and to be relatively low in a lower (i.e., the substrate side) portion D of the photoconductive layer 4, as in the first embodiment.

Description will be made on a method for manufacturing the image carrier 1 of this embodiment.

The step of forming the under coated layer 3 on the aluminum substrate 2 is the same as the first embodiment. Next, a photoconductive layer material in which polycarbonate resin serving as the binder resin and phthalocyanine pigment serving as the photoconductive particles 17 have been dispersed at a weight ratio of 1:1, and molybdenum particles serving as the conductive particles 7 are dissolved in a tetrahydrofran solvent so as to obtain a coating solution having the conductive particles 7 dispersed independently. The coating solution is applied onto the formed under coated layer 3.

In that case, the application is performed in first and second application steps as in the first embodiment, while the following first and second coating solutions are used as coating solutions in the first and second application steps respectively. Thus, the concentration of the conductive particles 7 in the photoconductive layer 4 is varied.

More specifically, the first coating solution to be used in the first application step is produced as follows. Molybdenum particles whose mean number particle size is 3 μm is set to account for C % (e.g. 15%) by weight, and the aforementioned photoconductive layer material is set to account for (100-C) % (e.g. 85%) by weight. A solution is prepared using tetrahydrofran as a solvent so that the concentration of solid concentrations (the conductive particles 7 and the photoconductive layer material) is 20% by weight. Then, the solution in which the molybdenum particles having a mean number particle size of 3 μm, the photoconductive layer material and the tetrahydrofran have been mixed thus is put into a vessel having a volume of 500 ml, together with glass beads, and dispersed by a paint shaker. Thus, the first coating solution is completed.

The second coating solution to be used in the second application step is produced as follows. Molybdenum particles whose mean number particle size is 3 μm is set to account for D % (D>C, e.g. 25%) by weight larger than the aforementioned ratio C % by weight, and the aforementioned photoconductive layer material is set to account for (100-D) % (e.g. 75%) by weight. A solution is prepared using tetrahydrofran as a solvent so that the concentration of solid concentrations is 20% by weight. Then, in the same manner as in the case of the first coating solution, the solution in which the molybdenum particles having a mean number particle size of 3 μm, the photoconductive layer material and the tetrahydrofran have been mixed thus is put into a vessel having a volume of 500 ml, together with glass beads, and dispersed by a paint shaker. Thus, the second coating solution is completed. The first and second application steps are the same as those in the first embodiment. Any others are the same as those in the first embodiment.

Figure 13:
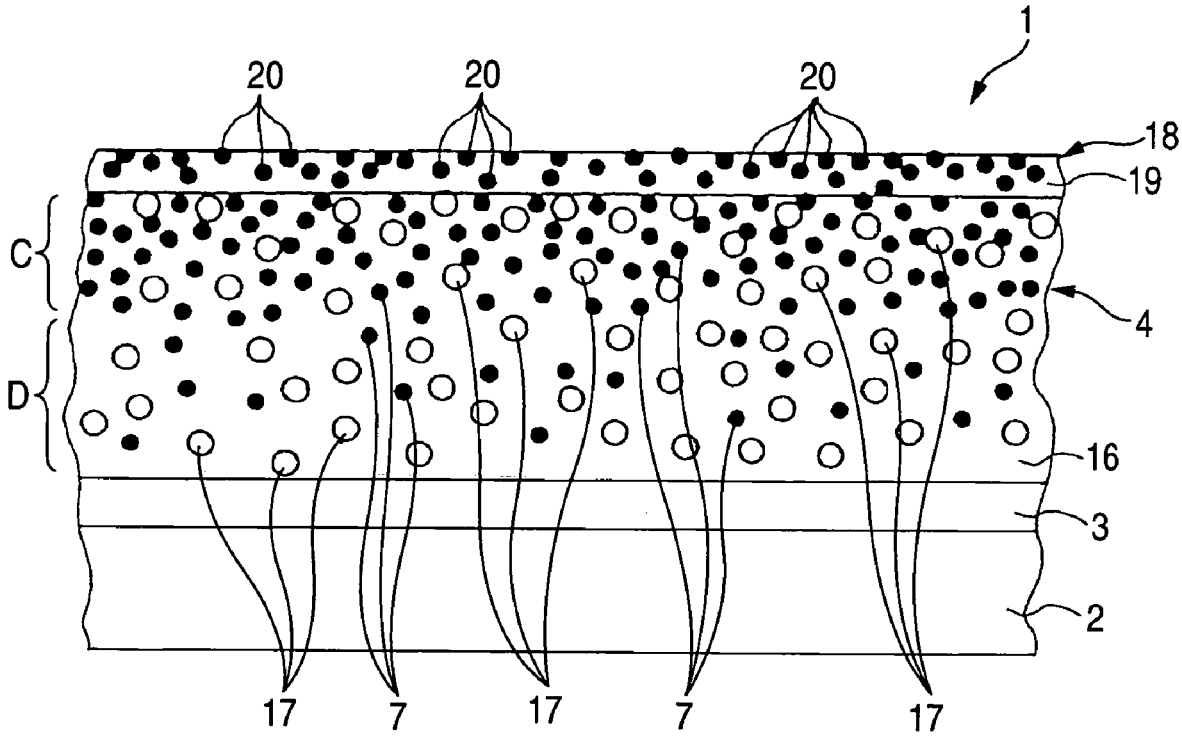
FIG. 13 is a schematic section view of an image carrier according to an eleventh embodiment of the invention.

FIG. 13 shows an eleventh embodiment of the invention. In this embodiment, a large number of conductive particles 20 are independently dispersed into the charge injection layer 18 while some of the conductive particles 20 are exposed on the surface of the charge injection layer 18 as in the fourth embodiment. Any others are the same as those in the fourth embodiment.

For the tenth and eleventh embodiments, the aforementioned charge generation material and the charge transport material may be dispersed concurrently in the binder resin 16 in place of the photoconductive particles 17 so as to form the photoconductive layer 4.

Further, the configuration explained in connection with any other embodiments may be applicable.

For the above embodiments, if there is no fear that there occurs a problem of leakage of charges in the thickness direction of the image carrier 1, it is not necessary to vary the concentration of the conductive particles 7.

In addition, instead of the paint shaker, an ultrasonic transducer may be put into the aforementioned coating solution having molybdenum particles having a mean number particle size of 3 μm, charge transport layer resin and tetrahydrofran mixed with one another, so as to disperse the coating solution by use of ultrasonic vibrational energy. Alternatively, the coating solution may be dispersed in another simple dispersion method such as vibration or agitation. Further, coating solutions may be produced easily using Micropearl AU (manufactured by Sekisui Chemical Co., Ltd.) as the conductive particles 7, 20. Micropearl AU is fabricated such that the outer circumferences of resin particles are plated with gold. Thus, the particles are lower in specific gravity than metal particles, so as to improve the dispersion property of the coating solution applied to the photoconductive layer 4. Accordingly, the effect of improving productivity in application steps can be expected.

Next, a twelfth embodiment will be described. The similar components to those shown in FIGS. 20 to 22 will be designated by the same reference numerals, and repetitive explanations for those will be omitted.

Figure 14:
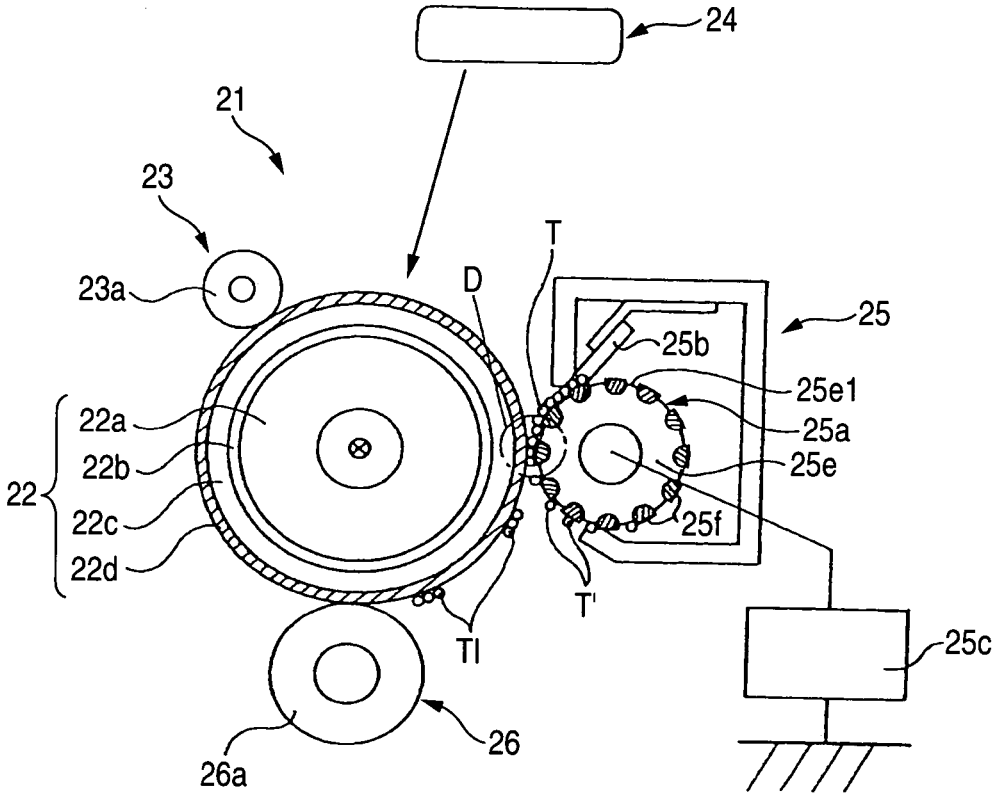
FIG. 14 is a schematic view of an image forming apparatus according to a twelfth embodiment of the invention.
Figure 20:
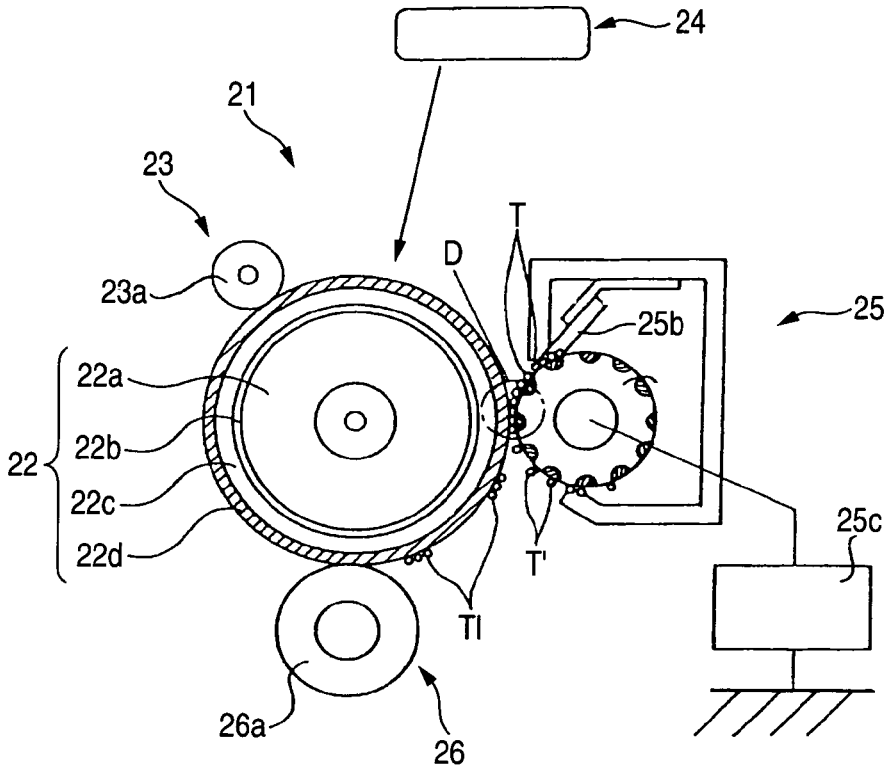
FIG. 20 is a schematic view of a related-art image forming apparatus.

As shown in FIG. 14, an image forming apparatus 21 in this embodiment has the same configuration as that of the aforementioned image forming apparatus 21 shown in FIG. 20. That is, the image forming apparatus 21 in this embodiment comprises an image carrier 22, a charger 23, an exposer 24, a FEED type developing device 25 and a transferer 26.

Figure 15:
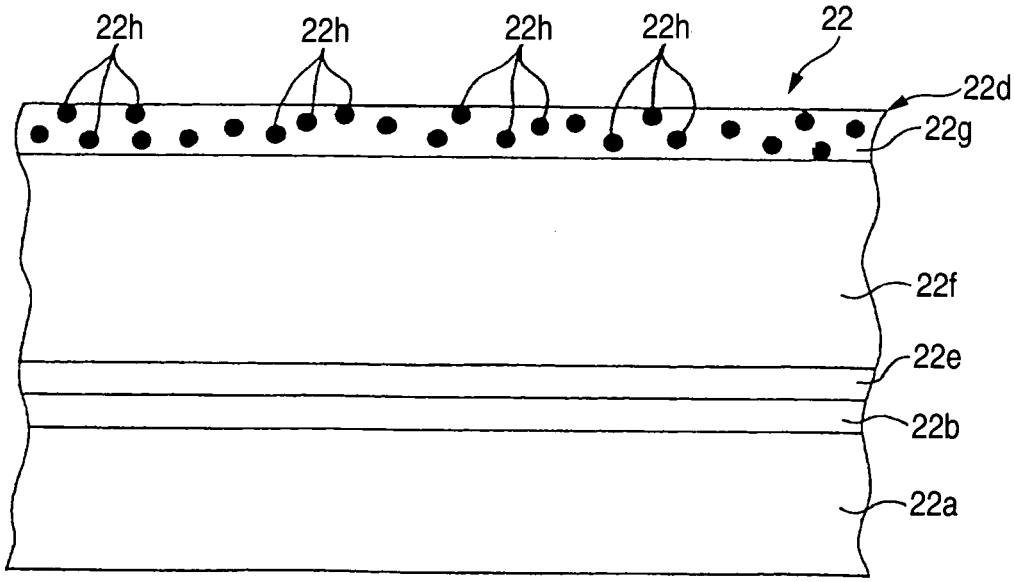
FIG. 15 is a schematic section view of an image carrier in the image forming apparatus of FIG. 14.

As shown in FIG. 15, the image carrier 22 comprises a substrate 22*a*, a under coated layer 22*b*, a photosensitive layer 22*c* and a charge injection layer 22*d* in the same manner as the image carrier 22 of the image forming apparatus 21 shown in FIG. 20. The photosensitive layer 22*c* includes a charge generation layer 22*e* formed on the under coated layer 22*b*, and a charge transport layer 22*f* formed on the charge generation layer 22*e*. The charge injection layer 22*d* of the image carrier 22 is formed on the charge transport layer 22*f*, and comprised of binder resin 22*g* and a large number of conductive particles 22*h* independently dispersed in the binder resin 22*g*.

The cylindrical substrate 22*a* is a conductive material such as aluminum. Specifically, the substrate 22*a* is formed to have an outer diameter of about 30 mm and a thickness of 1-2 mm.

The under coated layer 22*b* is an insulative thin film layer provided for blocking charge injection from the surface of the photosensitive layer 22*c* or the substrate 22*a*. For example, the under coated layer 22*b* is formed out of a resin layer of nylon resin or the like, or an anodized aluminum layer. The film thickness of the under coated layer 22*b* is 0.5-5 μm, preferably 0.5-1.5 μm.

The charge generation layer 22*e* has a function of generating charges in response to received light. The charge generation layer 22*e* may contain dispersed charge generation material, or may be formed by vacuum deposition of an amorphous silicon layer on the aforementioned substrate 22*a*. The film thickness of the charge generation layer 22*e* is 0.5-2 μm, preferably 0.5-1.5 μm.

In the former case, for example, resin such as polyvinyl butyral resin can be used as the binder resin. Bisazo-based or phthalocyanine-based pigment can be used as the charge generation material. The charge generation layer 22*e* is formed by applying the charge generation material onto the under coated layer 22*b* so as to have a predetermined film thickness within the aforementioned film thickness range. Then, by use of the bisazo-based or phthalocyanine-based pigment, the image carrier 22 is constructed as an organic photosensitive (OPC).

In the latter case, the conductive particulates are vacuum-deposited together when amorphous silicon is vacuum-deposited to form the charge generation layer 22*e*. The image carrier 22 is constructed as an inorganic photosensitive.

The charge transport layer 22*f* has a function of transporting charges generated in the charge generation layer 22*e*. The charge transport layer 22*f* is formed by mixing a compound having a charge transport property (hereinafter also referred to as "charge transport material") into binder resin exhibiting a dielectric property. For example, polycarbonate, polyethylene, polyvinyl chloride, polyolefin or polyethylene terephthalate may be used as the binder resin, and a hydrazone-based material may be used as the charge transport material. The charge transport layer 22*f* is formed by application onto the charge generation layer 22*e* so as to have a predetermined film thickness (10-30 μm).

The charge injection layer 22*d* is constructed so that a large number of conductive particles 22*h* are substantially uniformly dispersed in the binder resin 22*g*. The film thickness of the charge injection layer 22*d* is 1-15 μm, preferably 2-5 μm, for the following reason. That is, when the charge injection layer 22*d* is too thin, the charge injection layer 22*d* will be shaved off so that the durability will be lost. On the contrary, when the charge injection layer 22*d* is too thick, the light energy in the optical writing will be absorbed (i.e. converted into heat) or latent image data written optically will leak in the surface direction in the charge injection layer 22*d* so that the latent image may be blurred.

Examples of resins usable as the binder resin 22*g* include phosphazene resin, polycarbonate resin, polyacethylene resin, polyimide resin, polyvinyl acetate resin, etc. However, the binder resin 22*g* is not limited to those resins. Any resin may be used if it has an insulating property and exhibits a dielectric property. Metal particulates of tungsten, molybdenum, tantalum, gold, silver, iron, etc., particulates of tin oxide ($SnO_2$) doped with antimony, indium or the like to be thereby made conductive, or particulates of other metal oxides such as titanium oxide ($TiO_2$), conductive carbon or the like, can be used as the conductive particles 22*h*.

Next, description will be made on an example of a method for manufacturing the image carrier 22 of this embodiment.

The method for manufacturing the image carrier 22 arranged as an OPC can be manufactured in a well-known dip coating method (water method). Specifically, a under coated layer solution in which methoxymethylated nylon exhibiting ionic conductivity to some extent has been mixed into insulating nylon resin is applied onto a cylindrical substrate 22*a* made from an aluminum material and having an outer diameter of about 30 mm and a thickness of 1.5 μm so that an insulative thin film under coated layer 22*b* is formed to be about 1 μm thick.

Next, a solution in which polyvinyl butyral resin serving as the binder resin and bisazo-based pigment serving as the charge generation material have been dispersed at a weight ratio of 1:2 is applied onto the formed under coated layer 22*b* so as to form the charge generation layer 22*e* about 1 μm thick. Next, charge transport layer resin in which polycarbonate resin serving as the binder resin and hydrazone serving as the charge transport material have been dispersed at a weight ratio of 1:1 is dissolved in a tetrahydrofran solvent so as to obtain a charge transport layer solution. The charge transport layer solution is applied onto the formed charge generation layer 22*e*.

Next, as the conductive particles 22*h*, particulates of tin oxide ($SnO_2$) doped with antimony, indium or the like to be thereby made conductive are independently dispersed into phosphazene resin serving as the binder resin 22*g*, so as to account for 70% by weight (obtained by dividing weight of the conductive particulates by weight of the binder resin). The solution obtained thus is applied onto the formed charge transport layer 22*f* so as to form the charge injection layer 22*d* about 5 μm thick. Thus, the image carrier 22 is manufactured. In the image carrier 22, the charge injection layer 22*d* is formed by independently dispersing a large number of conductive particles 22*h* into the binder resin 22*g* so that the image carrier 22 can be charged by charge injection.

Figure 16:
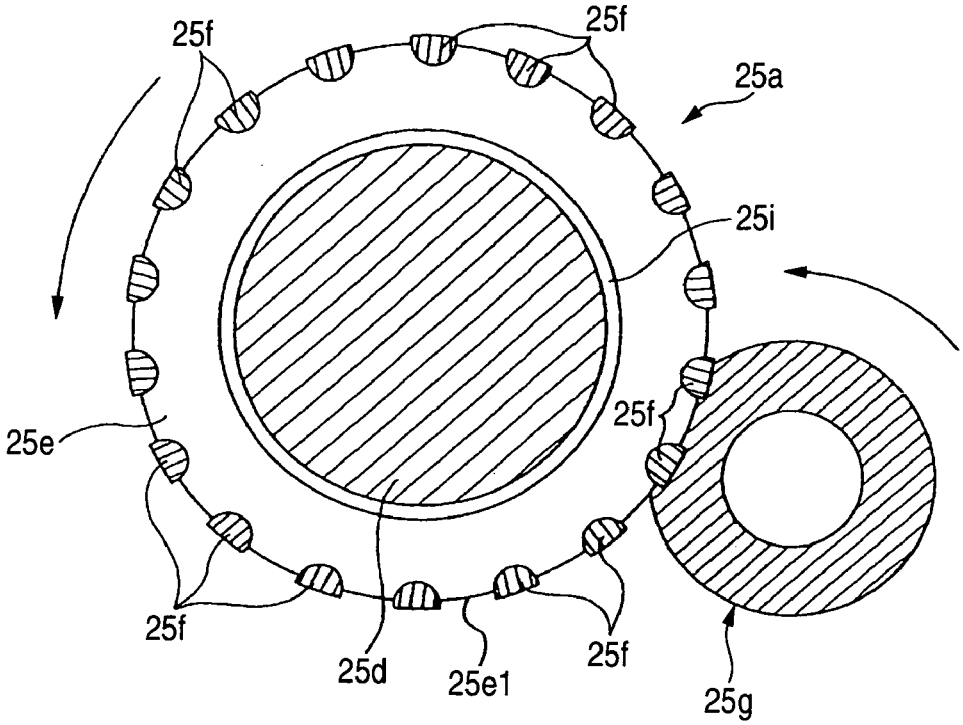
FIG. 16 is a schematic section view of a developing roller and a toner supply roller in the image forming apparatus of FIG. 14.

As shown in FIGS. 14 and 16, the FEED type developing device 25 comprises a developing roller 25*a*, a control blade 25*b*, a developing bias power supply 25*c* and a toner supply roller 25*g* while the developing roller 25*a* is comprised of a core member 25*d* and an insulative portion 25*e* having a large number of independent floating electrodes 25*f* in the surface layer of the insulative portion 25*e*.

In this embodiment, a large number of independent floating electrodes 25*f* are provided so as to project from an outer circumferential surface 5*e*1 of the insulative portion 25*e* of the developing roller 25*a*. It is preferable that the projecting length of each independent floating electrode 5*f* from the outer circumferential surface 25*e*1 is made larger than the mean number particle size of toner particles. As a result, even if the insulative portion 25*e* is filmed with the minute toner T, the minute toner T on the insulative portion 25*e* will be difficult to adhere to the image carrier 22.

For example, the conductive core member 25*d* is formed into a columnar shape out of a conductive member of aluminum or the like. Examples of resins useable as the insulative portion 25*e* formed on the core member 25*d* include phosphazene resin, polycarbonate resin, polyacethylene resin, polyimide resin, polyvinyl acetate resin, etc. The insulative portion 25*e* is not limited to these resins. Any resin can be used if it is a resin having an insulating property and exhibiting a dielectric property.

Metal particulates of tungsten, molybdenum, tantalum, gold, silver, iron, etc., particulates of tin oxide ($SnO_2$) doped with antimony, indium or the like to be thereby made conductive, or particulates of other metal oxides such as titanium oxide ($TiO_2$), conductive carbon or the like, can be used as the independent floating electrodes 25*f*.

Next, description will be made on an example of a method for manufacturing the developing roller 25*a* of this embodiment.

The developing roller 25*a* can be manufactured in the well-known dip coating method (water method). Specifically, a under coated layer solution in which methoxymethylated nylon exhibiting ionic conductivity to some extent has been mixed into insulating nylon resin is first applied onto the core member 25*d* made from an aluminum material and having an outer diameter of about 20 mm in the same manner as in the aforementioned image carrier 22. Thus, an insulative thin film under coated layer 25*i* is formed to be about 1 μm thick.

Next, an insulating layer having a film thickness of about 20 μm is formed on the formed under coated layer 25*i* by use of polycarbonate resin as the resin of the insulative portion 25*e*. Further, polycarbonate resin serving as binder resin and molybdenum particles are dissolved in a tetrahydrofran solvent so as to obtain a coating solution having the molybdenum particles dispersed independently. The coating solution is applied onto the insulating layer so as to form a film about 3.0 μm thick. Thus, a large number of independent floating electrodes 25*f* comprised of the molybdenum particles are formed in the surface layer of the insulative portion 25*e*. Next, a tetrahydrofran or aceton solvent is applied, by a dipping method or a spraying method, to the surface of the insulative portion 25*e* having a large number of independent floating electrodes 25*f* dispersed independently. Thus, the binder resin (polycarbonate resin) in the surface layer of the insulative portion 25*e* is dissolved to separate out the independent floating electrodes 25*f* and make them project from the surface of the insulative portion 25*e* by a projecting length of about 30 μm. Incidentally, the solvent is not limited to tetrahydrofran or acetone, but any solvent may be used if it can dissolve the binder resin 22*g*. In such a manner, the FEED type developing roller 25*a* having a large number of independent floating electrodes 25*f* formed to project over the insulative portion 25*e* is formed.

The aforementioned methods for manufacturing the image carrier 22 and the developing roller 25*a* are not limited to the aforementioned methods described by way of example. Various known methods can be adopted.

The charger 23, the toner supply roller 25*g*, the transferer 26, etc. similar to those in the image forming apparatus shown in FIG. 20 may be used.

In this embodiment, minute toner T in which toner particles having a mean number particle size of 0.5-5.0 μm have been externally added with a fluidity enhancing agent is used. For example, toner disclosed in Japanese Patent No. 3372650 can be used as the minute toner T. As is taught in this publication, it is difficult to provide an adequate frictional charge amount when the mean number particle size of toner particles is smaller than 0.5 μm. On the other hand, it is difficult to obtain a high quality image when the mean number particle size of toner particles is larger than 5.0 μm.

This publication further teaches it is preferable that the content of toner particles whose particle size is not smaller than 6.0 μm is not higher than 5% by number, in order to avoid conspicuous deterioration in the tone reproducibility of an image having a resolution of 600 lines/inch. Further, in order to prevent the image contrast from deteriorating considerably due to severe fogging, it is preferable that the content of toner particles whose particle size is not larger than 0.3 μm is not higher than 15% by number.

Meanwhile, various fluidity enhancing agent may be externally added to the toner T to improve the development performance, the conveyance performance. Examples of the fluidity enhancing agents include fine powder of silica, fine powder of titanium oxide, fine powder of alumina, and fine powder of magnesium stearate. In this case, it is preferable that the specific surface area of the fluidity enhancing agent measured by nitrogen adsorption in a BET method is not smaller than 300 $m^2/g$, and it is preferable that the loading of the fluidity enhancing agent is in a range of 1-50 wt % though it depends on the particle size of the toner.

Figure 17:
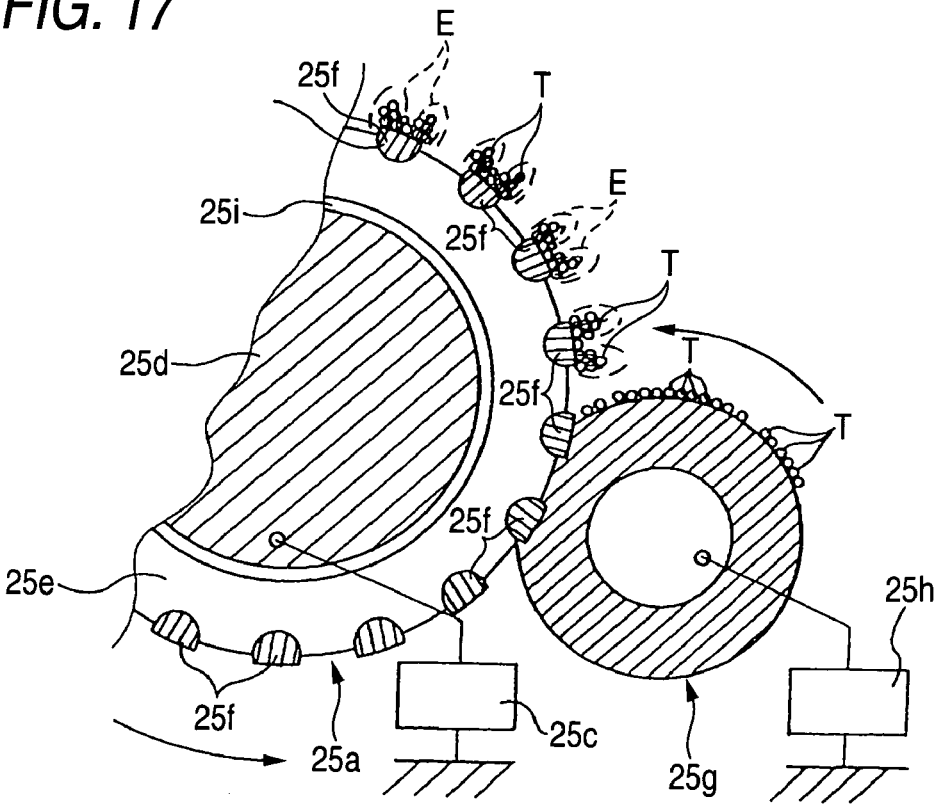
FIG. 17 is a schematic view for explaining toner conveyance onto the developing roller of FIG. 16.

In this embodiment, the independent floating electrodes 25*f* of the developing roller 25*a* are frictionally charged due to frictional contact with the toner supply roller 25*g*, while the toner T conveyed from the toner tank by the toner supply roller 25*g* is charged due to friction so as to electrostatically adhere to the independent floating electrodes 25*f* of the developing roller 25*a*. Here, as shown in FIG. 17, since the independent floating electrodes 25*f* are projected from the outer circumferential surface 25*e*1 of the developing roller 25*a* (i.e., the insulative portion 25*e* is recessed from the tip end faces of the independent floating electrodes 25*f*), the minute toner T positively and reliably adheres to the independent floating electrodes 25*f*. Further, since the developing roller 25*a* forms closed electric fields E, the minute toner T adhering to the independent floating electrodes 25*f* is strongly attracted toward the developing roller 25*a*. Thus, the minute toner T becomes difficult to separate from the developing roller 25*a*.

In this embodiment, the charging roller 23*a* of the charger 23 is brought into contact with the charge injection layer 22*d* so as to inject charges into the conductive particles 22*h* of the charge injection layer 22*d* of the image carrier 22 due to a charging voltage of the charging roller 23*a*. Thus, the image carrier 22 is charged uniformly.

Exposure using the exposer 24 is performed on the charged image carrier 22 so as to write an electrostatic latent image onto the image carrier 22. In the developing device 25, the minute toner T in the toner tank is conveyed by the toner supply roller 25*g* to which a supply bias voltage is applied in accordance with necessity. Thus, the minute toner T is supplied onto the developing roller 25*a*. The developing roller 25*a* applied with the developing bias voltage carries and conveys the minute toner T to the image carrier 22. Incidentally, the thickness of minute toner T on the developing roller 25*a* is regulated by the control blade 25*b*, and conveyed to the development position D where the developing roller 25*a* faces the image carrier 22.

In the development position D, the latent image written on the image carrier 22 is developed with the toner conveyed by the developing roller 25*a* of the developing device 25. In this event, the development is performed reliably by the minute toner T adhering to the projected independent floating electrodes 25*f*. Thus, the electrostatic latent image formed on the image carrier 22 is reproduced reliably as an excellent toner image. In this case, the recessed insulative portion 25*e* may be filmed with the minute toner T. However, the toner T adhering to the projected independent floating electrodes 25*f* is used for the development while the minute toner T filming the recessed portions of the insulative portion 25*e* is not used for the development. In addition, since the occupying area of the toner T to be used for development in the independent floating electrodes 25*f* can be prevented from being reduced due to the minute toner T adhering to the insulative portion 25*e*, the toner conveyance rate can be prevented from changing, while a required toner conveyance rate can be secured over a long time period.

Since the minute toner T is conveyed chiefly due to electrostatic force by use of the FEED type developing roller 25*a*, it is possible to suppress filming which will occur in the mechanical irregular portions of a conventional non-FEED type developing roller when the minute (not larger than 3 μm) toner T is conveyed by the developing roller. Thus, it is possible to perform secure toner conveyance (as to the charge amount, the conveyance rate, and the uniformity of conveyance in the roller axis direction) free from influence of the mechanical irregular shape in the surface of the developing roller.

In an image carrier including a charge injection layer having independent floating electrodes in its surface layer as disclosed in Japanese Patent Publication No. 9-218566A, an electrostatic latent image is developed into a toner image due to a conductive developing roller brought into pressure contact with the charge injection layer. Incidentally, static electricity in the surface layer of the image carrier charged by the independent floating electrodes forms an electric path when the image carrier comes into contact with the developing roller. Thus, a latent image formed on the image carrier is discharged or charged by the developing roller in prior to development, thereby disturbing the latent image.

To solve this problem, in this embodiment, the image carrier 22 including the charge injection layer 22*d* having a large number of conductive particles 22*h* dispersed independently is combined with the FEED type developing roller 25*a* having the independent floating electrodes 25*f* dispersed independently. Thus, the minute toner T is conveyed, and the FEED type developing roller 25*a* is brought into contact with the image carrier 22. In contact development of a latent image with the conveyed toner T, the electrostatic latent image in the surface layer of the image carrier 22 can be prevented from leaking through the developing roller 25*a*. Accordingly, the electrostatic latent image formed on the image carrier 22 by the charge injection or the optical writing can be reproduced reliably as an excellent toner image by the FEED type developing roller 25*a*.

Next, a change of filming of the developing roller with toner in the image forming apparatus 21 of this embodiment was tested by experiments. The experiments includes Experiment 1 for testing filming of the developing roller 25*a* with toner T and Experiment 2 for testing leakage of an electrostatic latent image on the image carrier 22 having the charge injection layer 22*d* at the time of contact development with the developing roller 25*a*.

In Experiment 1, durabilities of the following examples were tested. An outer diameter of each developing roller was 16 mm.

Figure 21:
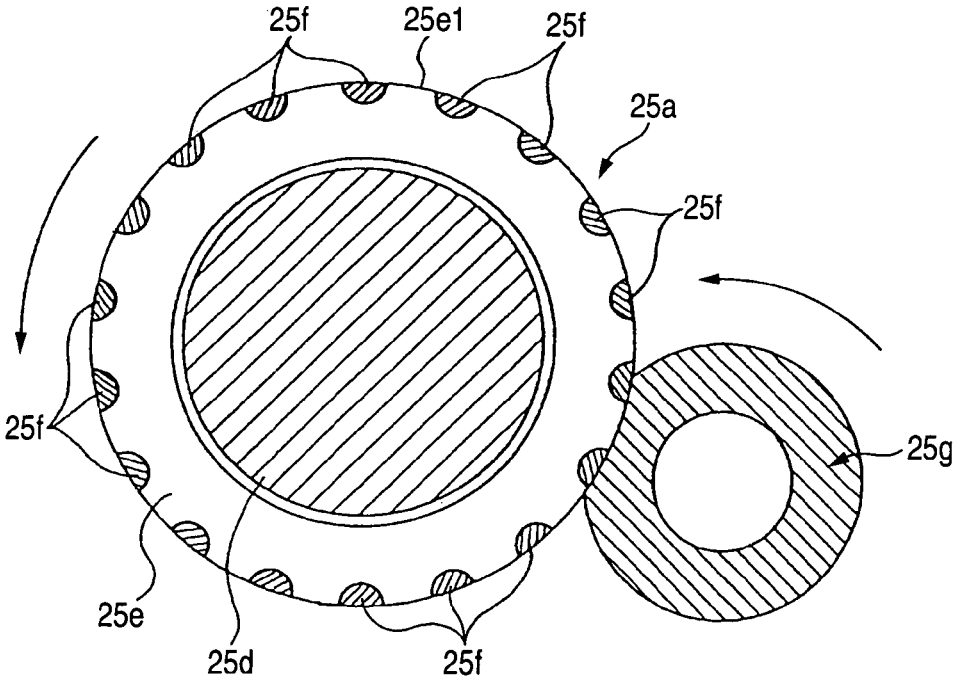
FIG. 21 is a schematic section view of a developing roller and a toner supply roller in the image forming apparatus of FIG. 20.
Figure 22:
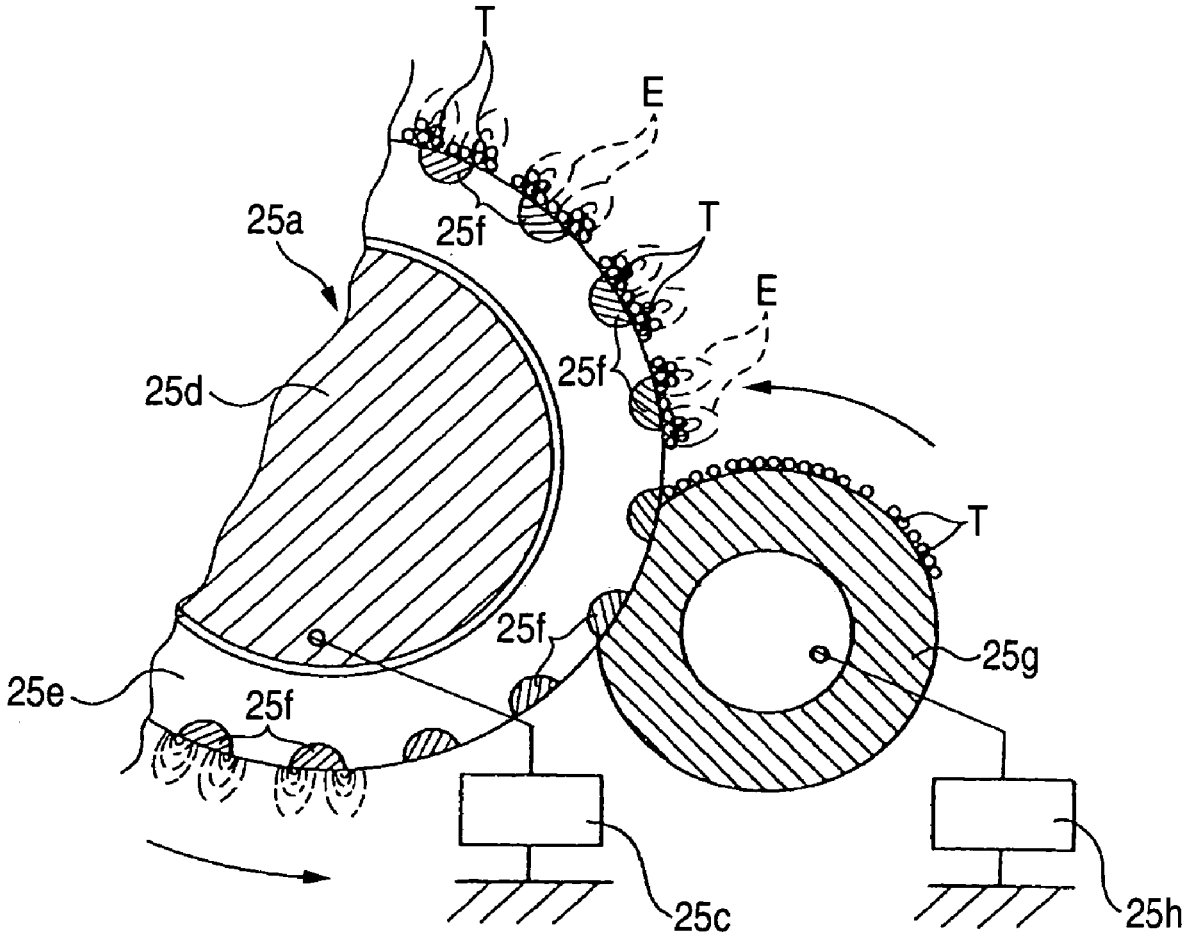
FIG. 22 is a schematic view for explaining toner conveyance onto the developing roller of FIG. 21.

Example A: non-contact development with a conventional developing roller made from rubber, a surface of which has been subjected to mechanical grinding (electric resistance: $10^{8}$ Ω·cm; surface roughness obtained by average roughness at 10 points: 3.0 μm);

Example B: non-contact development with a conventional developing roller made from metal, a surface of which has been subjected to mechanical grinding (electric resistance: $10^{-5}$ Ω·cm; surface roughness obtained by average roughness at 10 points: 3.0 μm);

Example C: contact development with a conventional developing roller made from rubber, a surface of which has been subjected to mechanical grinding (electric resistance: $10^{8}$ Ω·cm; surface roughness obtained by average roughness at 10 points: 3.0 μm);

Example D: non-contact development with the FEED type developing roller shown in FIG. 21 (the independent floating electrodes are flush with the insulative portion);

Example E: contact development with the FEED type developing roller shown in FIG. 21 (the independent floating electrodes are flush with the insulative portion);

Example F: non-contact development with a FEED type developing roller in which independent floating electrodes are recessed from an insulative portion (core member: aluminum material; insulative portion: polycarbonate; independent floating electrode: molybdenum particles having average particle size of 1.5 μm; recessed dimension of independent floating electrode: 3.0 μm; electric resistance: $10^{8}$ Ω·cm; surface roughness obtained by average roughness at 10 points: 4.0 μm);

Example G: contact development with a FEED type developing roller in which independent floating electrodes are recessed from an insulative portion (core member: aluminum material; insulative portion: polycarbonate; independent floating electrode: molybdenum particles having average particle size of 1.5 μm; recessed dimension of independent floating electrode: 3.0 μm; electric resistance: $10^{8}$ Ω·cm; surface roughness obtained by average roughness at 10 points: 4.0 μm);

Example H: non-contact development with the FEED type developing roller shown in FIG. 16 (core member: aluminum material; insulative portion: polycarbonate; independent floating electrode: molybdenum particles having average particle size of 1.5 μm; projected dimension of independent floating electrode: 3.0 μm; electric resistance: $10^{8}$ Ω·cm; surface roughness obtained by average roughness at 10 points: 4.0 μm); and Example I: contact development with the FEED type developing roller shown in FIG. 16 (core member: aluminum material; insulative portion: polycarbonate; independent floating electrode: molybdenum particles having average particle size of 1.5 μm; projected dimension of independent floating electrode: 3.0 μm; electric resistance: $10^{8}$ Ω·cm; surface roughness obtained by average roughness at 10 points: 4.0 μm).

The toner disclosed in Japanese Patent No. 3372650 as the first embodiment was used. Specifically, a solution containing 540 parts of ethanol, 60 parts of n-hexane and 60 parts of poly methyl vinyl ether (weight average molecular weight 28,000) was put into a 1-liter four-neck flask to which a reflux condenser tube, a thermometer and a nitrogen introduction capillary were attached. Thus, a polymeric medium was prepared. Next, 100 parts of styrene monomer, 5.0 parts of C. I. pigment blue 15:3, 5.0 parts of di-t-butyl metal-salicylate compound and 1.0 part of 2,2'-azobisisobutyronitrile were put into the flask and mixed sufficiently. Next, their reaction cocktail was refluxed in a nitrogen gas flow at 70° C. for 6 hours. By use of a centrifugal separator, methyl alcohol was repeatedly decanted into a reaction cocktail obtained after reaction. Thus, poly methyl vinyl ether as a polymeric matrix was cleansed and removed. After that, the obtained reaction product is vacuum-dried to obtain toner particles whose average particle size was 1.0 μm. To 2 parts of the toner particles, 0.4 parts of fused titanium oxide having a BET value of 350 $m^2$ was mixed by a Henschel mixer so as to externally add the fine powder of titanium oxide to the toner particles. Thus, the toner was obtained.

A shadow image was printed in a monochrome mode in LP-1500C (manufactured by Seiko Epson Corporation) on the basis of the developing conditions where the developing efficiency would be maximum for each developing roller. The distance between the developing roller 25*a* and the image carrier 22 was set to be 150 μm in the case of non-contact development. The case where the maximum developing efficiency was below 70% as of 10,000 printed sheets was regarded as a defective image forming apparatus.

Figure 18A:
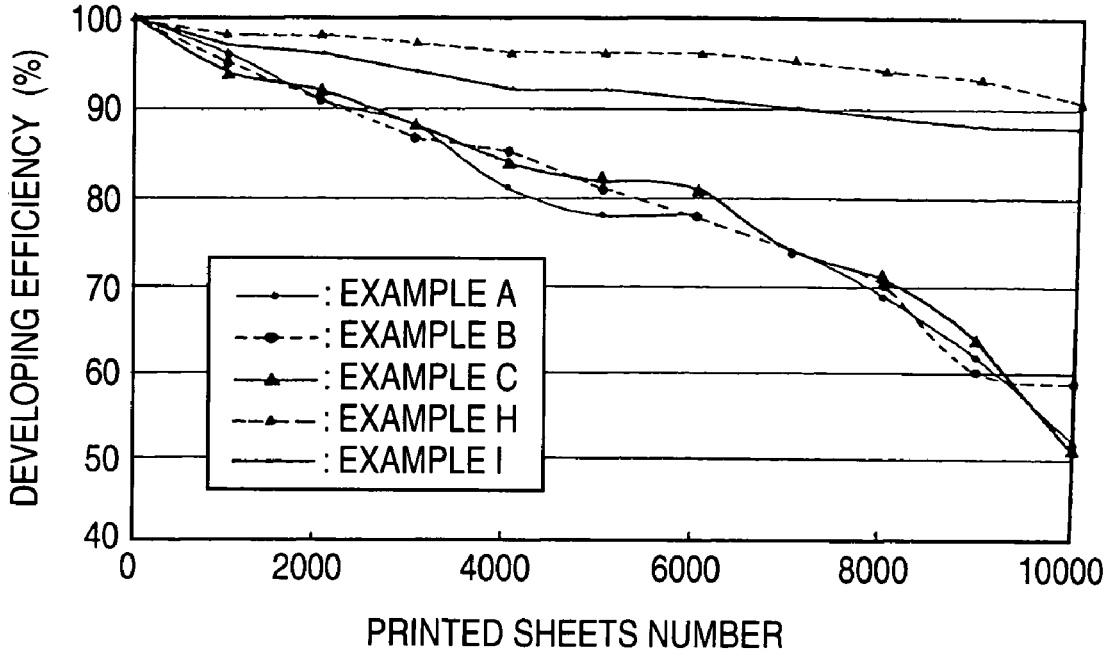
FIGS. 18A and 18B are graphs showing experimental results for explaining advantages of the invention.
Figure 18B:
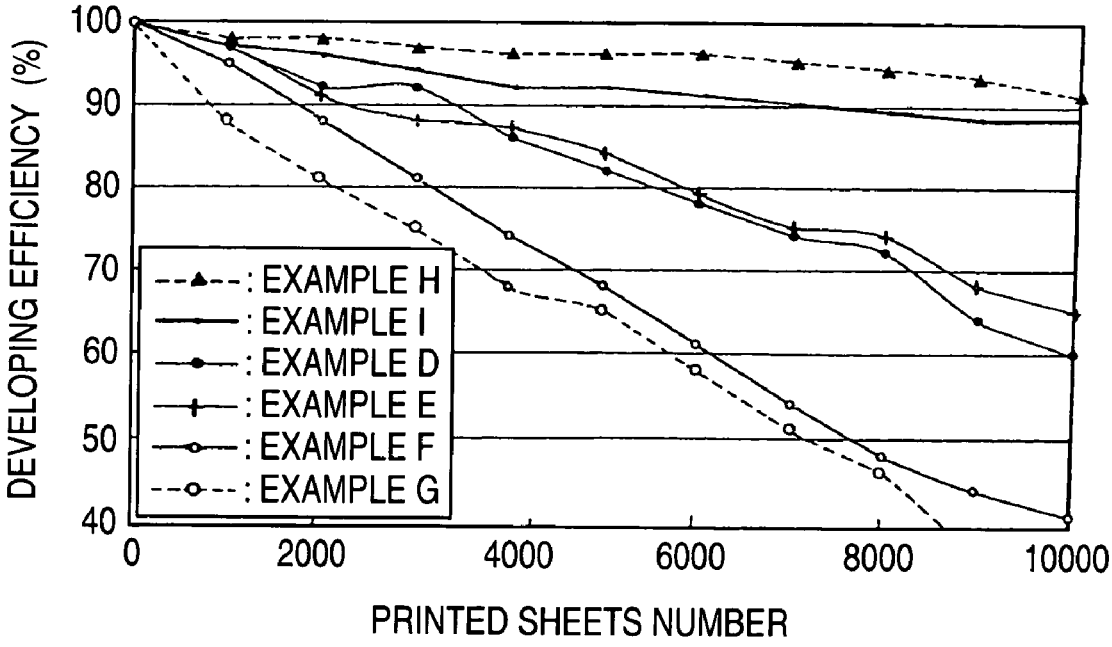

The experimental results were shown in FIGS. 18A and 18B. As is apparent from FIG. 18A, in each of the Examples A to C, the developing efficiency dropped below 60% as of 10,000 printed sheets. Thus, it was confirmed that when the conventional developing roller is used, the surface of the developing roller is filmed with toner in both the non-contact development and the contact development, causing a failure in image formation.

Figure 19A:
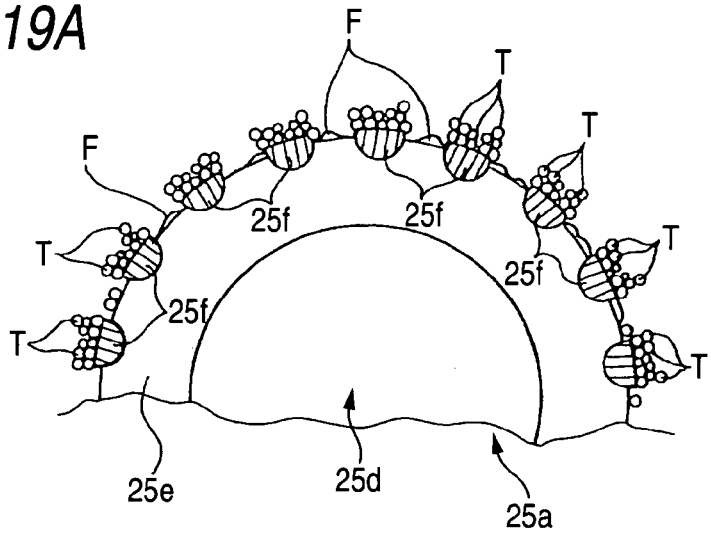
FIGS. 19A to 19C are schematic section views for explaining the experimental results of FIGS. 18A and 18B.
Figure 19B:
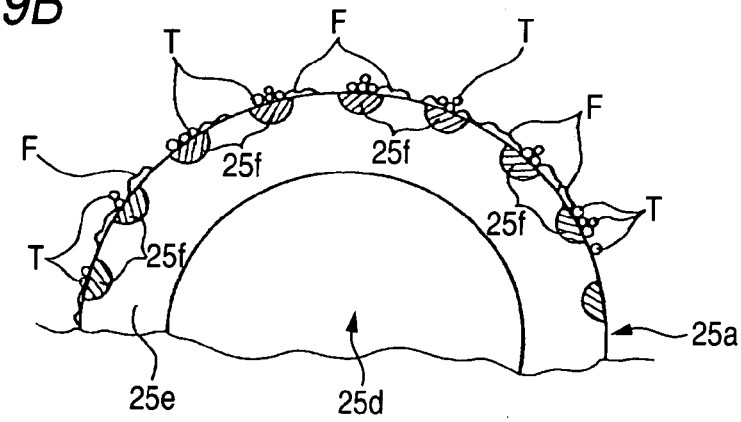

In addition, as is apparent from FIG. 18B, in each of the Examples D and E, the developing efficiency dropped below 70% as of 10,000 printed sheets. It can be considered that this is because the insulative portion 25*e* is filmed with the toner T as shown in FIG. 19B due to printing over a long time period, and the toner filming the insulative portion 25*e* adheres to the image carrier 22 in the development position D together with the toner adhering to the independent floating electrodes 25*f*. That is, it was confirmed that when the independent floating electrodes 25*f* are flush with the insulative portion 25*e*, the surface of the insulative portion 25*e* of the developing roller 25*a* is filmed with toner in both the non-contact development and the contact development, causing a failure in image formation.

Figure 19C:
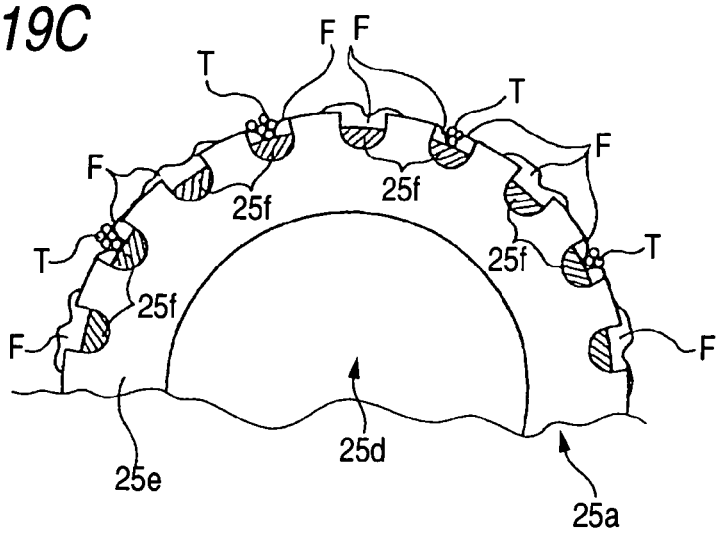

Further, in each of the Examples F and G, the developing efficiency dropped below 50% as of 10,000 printed sheets. This is because the recess portions of the insulative portion 25*e*, that is, the independent floating electrodes 25*f* are filmed with the toner T as shown in FIG. 19C due to printing over a long time period. Incidentally, the independent floating electrodes 25*f* may be filmed with the toner so as to be partially covered therewith, or filmed with the toner so as to be entirely covered therewith. When the independent floating electrodes 25*f* are entirely filmed with the toner, it is difficult for new toner particles to adhere to the independent floating electrodes 25*f*. When the independent floating electrodes 25*f* are partially filmed with the toner, new toner particles adhere only to the portions of the independent floating electrodes 25*f* which are not filmed. Thus, development is not performed well. In addition, the toner filming the insulative portion 25*e* adheres to the image carrier 22. It can be considered that the developing efficiency drops for those reasons. That is, it was confirmed that when the independent floating electrodes 25*f* are recessed from the insulative portion 25*e*, the independent floating electrodes 25*f* are filmed with toner in both the non-contact development and the contact development, causing a failure in image formation.

On the other hand, as is apparent from FIGS. 18A and 18B, in each of the Examples H and I, the developing efficiency does not drop so much but is about 90% in spite of 10,000 printed sheets. It can be considered that this is because the independent floating electrodes 25*f* are formed to be projected from the insulative portion 25*e* as shown in FIG. 19A so that the toner particles adhering to the independent floating electrodes 25*f* adhere to the image carrier 22 reliably, while the toner filming the insulative portion 25*e* hardly adheres to the image carrier 22. Thus, it was confirmed that in the image forming apparatus according to the invention, there is no influence of filming in spite of use of the minute toner T in the FEED type developing device, but satisfactory image formation can be reliably performed over a long time period.

In Experiment 2, for each of the developing rollers used in Examples C and I in Experiment 1, charge leakage of the latent image formed on the image carrier 22 at the time of contact development was tested.

As the image carrier 22 having the charge injection layer 22*d*, $SnO_2$ particulates treated to be conductive and polycarbonate were mixed at a mixing ratio (mass ratio) of 1:2.5, were dissolved in a tetrahydrofran solvent and applied onto the photosensitive drum of the image forming apparatus LP-1500C so as to form a layer 3 μm thick. Toner used in Experiment 1 was used also in this experiment.

A developing bias voltage was set at three voltages of −100 V, −200V and −300 V (DC voltage) for each developing roller, and a halftone image was printed by 100 sheets in a monochrome mode with the image forming apparatus LP-1500C. Then, it was examined whether there was a leak mark in a toner image on the image carrier or not. Any sheet having any leak portion was regarded as defective. The experimental results are shown in Table 1.

TABLE 1

| Developing bias (V) | rubber developing roller | FEED developing roller |
|---|---|---|
| −100 | 8/100 | 0/100 |
| −200 | 3/100 | 0/100 |
| −300 | 2/100 | 0/100 |

In this table, "8/100" means that leak portions were found in 8 sheets when 100 sheets were printed.

As is apparent from the results, when the rubber roller was used, of 100 sheets, 8 sheets had leak portions in the developing bias voltage of −100 V. In the developing bias voltage of −200 V, of 100 sheets, 3 sheets had leak portions. Further, in the developing bias voltage of −300 V, of 100 sheets, 2 sheets had leak portions.

On the other hand, when the FEED type developing roller according to the invention was used, of 100 sheets, there is no sheet having leak portions in each of the three developing bias voltages of −100 V, −200 V and −300 V. Accordingly, it was confirmed that in the image forming apparatus 21 of the invention, leakage of charges (electrostatic latent image) can be prevented reliably due to use of the FEED type developing roller in spite of an image carrier of the charge injection type, so that good image formation can be performed stably.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An image carrier in an image forming apparatus, on which an electrostatic latent image is formed, the image carrier comprising:

a conductive substrate;

an insulative layer, provided on the substrate; and a photosensitive layer, provided so as to cover the substrate, the photosensitive layer including:

a charge generation layer, provided on the insulative layer and operable to generate charges in response to incident light;

a first charge transport layer, provided on the charge generation layer, and containing a first amount of dispersed conductive particles; and a second charge transport layer, provided on the first charge transport layer and containing a second amount of the dispersed conductive particles which is greater than the first amount.

2. The image carrier as set forth in claim 1, further comprising a charge injection layer, laminated on the surface of the photosensitive layer, and containing dispersed conductive particles of tin oxide doped with either antimony or indium.

3. The image carrier as set forth in claim 1, wherein the dispersed conductive particles are molybdenum particles.

4. The image carrier as set forth in claim 1, wherein the dispersed conductive particles are resin particles, outer circumferences of which are plated with gold.

5. An image carrier in an image forming apparatus, on which an electrostatic latent image is formed, the image carrier comprising:

a conductive substrate;

an insulative layer, provided on the substrate;

a photosensitive layer, provided so as to cover the substrate, the photosensitive layer including:

a conductive substrate;

an insulative layer, provided on the substrate;

a photosensitive layer, provided so as to cover the substrate, the photosensitive layer including:

a charge generation layer, provided on the insulative layer and operable to generate charges in response to incident light; and a charge transport layer, provided on the charge generation layer and containing either dispersed molybdenum particles or dispersed resin particles outer circumferences of which are plated with gold; and a charge injection layer, laminated on the surface of the photosensitive layer, and containing dispersed conductive particles of tin oxide doped with either antimony or indium.

* * * * *